US007798352B2

(12) United States Patent
Naruishi et al.

(10) Patent No.: US 7,798,352 B2
(45) Date of Patent: Sep. 21, 2010

(54) PACKAGING DEVICE AND BUFFER

(75) Inventors: Moku Naruishi, Tokyo (JP); Tsuyoshi Abe, Tokyo (JP); Satoshi Ishihara, Tokyo (JP); Sakae Ishikawa, Tokyo (JP); Hideyuki Goda, Tokyo (JP); Tomoaki Arai, Tokyo (JP); Noriyuki Nakagawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1179 days.

(21) Appl. No.: 11/347,308

(22) Filed: Feb. 6, 2006

(65) Prior Publication Data

US 2006/0186072 A1 Aug. 24, 2006

(30) Foreign Application Priority Data

Feb. 7, 2005 (JP) ..... 2005-030375
Mar. 18, 2005 (JP) ..... 2005-079177
Oct. 25, 2005 (JP) ..... 2005-309414

(51) Int. Cl.
*B65D 88/00* (2006.01)
*B65D 90/12* (2006.01)

(52) U.S. Cl. ..... 220/1.5; 220/632

(58) Field of Classification Search ..... 220/4.33, 220/4.29, 632, 666, 4.01, 600; 108/57.12; 206/584, 600; 248/687; *B65D 6/24*
See application file for complete search history.

(56) References Cited

U.S. PATENT DOCUMENTS 1,661,527 A * 3/1928 De Boer ..... 217/43 R
2,775,360 A * 12/1956 Phillips ..... 220/4.28
3,351,027 A 11/1967 Ellard, Jr. et al.
3,861,554 A * 1/1975 Legg et al. ..... 220/4.28
4,015,715 A 4/1977 Kelf
4,775,068 A * 10/1988 Reiland et al. ..... 220/6
4,944,546 A * 7/1990 Keller ..... 296/61
5,755,472 A 5/1998 Clive-Smith
6,293,400 B1 9/2001 Arai et al.
6,343,555 B1 2/2002 Arai et al.
6,422,407 B2 7/2002 Arai
6,463,863 B1 10/2002 Ishikawa et al.
6,602,032 B2 8/2003 Arai
2004/0108316 A1* 6/2004 Trujillo ..... 220/4.28
2004/0182048 A1 9/2004 Matsumoto et al.
2005/0159839 A1 7/2005 Ishikawa et al.
2005/0188901 A1 9/2005 Arai et al.

FOREIGN PATENT DOCUMENTS

DE 21 36 164 A1 1/1972
DE 3301599 A1 * 7/1984

(Continued)

*Primary Examiner*—Anthony Stashick
*Assistant Examiner*—Robert J Hicks
(74) *Attorney, Agent, or Firm*—Oblon, Spivak, McClelland, Maier & Neustadt, L.L.P.

(57) ABSTRACT

A packaging device includes a bottom plate and a mounting plate arranged above the bottom plate at a specific distance form the bottom plate. An article to be transported is placed on the mounting plate. A cushioning member is arranged in a space between the bottom plate and the mounting plate. The cushioning member protects the article from shocks. A reinforcing unit is arranged on the bottom plate in the space between the bottom plate and the mounting plate so that support members of the article rest on the reinforcing unit.

12 Claims, 32 Drawing Sheets

FOREIGN PATENT DOCUMENTS

| | | | | |
|---|---|---|---|---|
| DE | 3301600 | A1 | * | 7/1984 |
| DE | 3840805 | A1 | * | 5/1990 |
| DE | 39 07 306 | A1 | | 9/1990 |
| DE | 201 04 347 U 1 | | | 9/2001 |
| EP | 49443 | A1 | * | 4/1982 |
| EP | 321859 | A2 | * | 6/1989 |
| EP | 0 675 048 | A1 | | 10/1995 |
| JP | 7-267249 | | | 10/1995 |
| JP | 2538555 | | | 4/1997 |
| JP | 9-267866 | | | 10/1997 |
| JP | 10-292326 | | | 11/1998 |
| JP | 11-059677 | | | 3/1999 |
| JP | 3080425 | | | 7/2001 |
| JP | 2001-335024 | | | 12/2001 |
| JP | 2002-2813 | | | 1/2002 |
| JP | 2002-113904 | | | 4/2002 |
| JP | 2002-264815 | | | 9/2002 |
| JP | 2003-261179 | | | 9/2003 |
| JP | 2003-312664 | | | 11/2003 |
| JP | 3648904 | | | 2/2005 |
| JP | 2005-54978 | | | 3/2005 |
| JP | 2006001637 | A | * | 1/2006 |
| WO | WO 9411259 | A1 | * | 5/1994 |

* cited by examiner

PACKAGING DEVICE AND BUFFER

CROSS-REFERENCE TO RELATED APPLICATIONS

This application is based upon and claims the benefit of priorities from Japanese Patent Application No. 2005-030375, filed Feb. 7, 2005, Japanese Patent Application No. 2005-079177, filed Mar. 18, 2005, and Japanese Patent Application No. 2005-309414, filed Oct. 25, 2005, the entire contents of which are incorporated herein by reference.

BACKGROUND OF THE INVENTION

1. Field of the Invention The present invention relates to a technology for transporting and delivering articles.

2. Description of the Related Art

Apparatuses manufactured in factories transported and delivered to distributors or customers. For example, products like image forming apparatuses, such as copying machines, printers, and facsimile machines, are precious and delicate and need to be handled carefully during their transportation. The articles may be transported by trucks, freight trains, or ships. During transportation, the articles may be lifted many times or temporarily stored in warehouses. Therefore, some articles are designed so that they do not get damaged during transportation Some products are once stored in a warehouse and then delivered to users. Others are directly delivered to a user from a factory. In any case, it is an important issue to protect the article from various external impacts and transporting environments, which the article undergoes during the transportation until it is delivered to the user and installed, and to deliver the article to the user without degrading its quality. That is, in the physical distribution process of the manufactured goods, it is desired to maintain the quality of the manufactured goods against vibrations and impacts generated when the goods are transported by transportation such as a truck, and external hazards (inertia and tilt due to a shift) generated by handling the goods at the time of reloading and storage performed at respective warehouse bases and working locations, and desired to provide package varieties having an effective function with respect to the transportability and loading/unloading work efficiency.

Conventionally, image forming apparatuses and the like are packed in a packaging material such as a cardboard box and delivered to users. This packaging material is opened by the user and stored as necessary, or disposed as a waste when it is not necessary.

In recent years, for resources saving, the packaging materials of various kinds of products such as image forming apparatuses are recycled. However, the conventional packaging material such as cardboard boxes has low durability, and is not suitable for using repeatedly for the transportation and storage of the products.

Furthermore, the conventional packaging material has to be prepared according to shapes and sizes different for each model, thereby causing a cost increase due to troublesome designing and management. In the case of a product such as an image forming apparatus, in which even in the same type, the size and the external shape become different due to the presence of optional devices, it is difficult to handle the product by a single type of a packaging material. Therefore, it can be considered to load the image forming apparatus on a pallet or a rack as described in Japanese Patent Application Laid-Open No. 2002-264815, and transport and deliver the apparatus.

The pallet and the rack can be reused, and can load thereon various types of products having different shapes and sizes. However, in the case of loading a heavy product such as a large-scale copying machine, the bottom plate of the pallet or the rack can be bent or deformed due to the impact when the product is loaded.

On the other hand, polyethylene terephthalate (PET) has an excellent impact resistance, and is light and used as a general-purpose plastic for industrial and household containers or the like. It is used as a familiar container known as "PET bottle", and the production thereof is increasing as containers having the capacity of 500 milliliters, 350 milliliters, 330 milliliters, 200 milliliters, and the like. On the other hand, there is an issue of increasing plastic waste year after year, and the same is true for PET bottles. In other words, when the waste PET bottle is burnt, toxic substances are left in the burnt ashes after incineration.

Materials can be recycled in various ways. In material recycle, pellets are formed by crushing or grinding the waste without causing any chemical change, and are reused as a raw material. In thermal recycle, the waste is reused as a fuel for power generation combined with refuse incinerator. In chemical recycle, a resin is melted and dissolved to be returned to a chemical material, and is reused as a material. However, the recycling rate is not so high, and when the waste is finally disposed, the above problem will happen.

Another way is to wash the collected PET bottles reuse them. However, the time and trouble have to be taken for washing the bottles and the like, and with the continuously increasing number of PET bottles currently being used, this measure is not good enough for the waste PET bottles.

Japanese Patent Application Laid-Open No. 2002-002813 discloses a cushioning material for packaging arranged between an article to be packed and a case, to absorb impacts and an external force due to a pressing force. This cushioning material is arranged in a plurality of numbers on a flat board with cylindrical portions being parallel with each other, and includes a first bending groove provided on the flat board substantially in parallel with the cylindrical portion, at a position where the cushioning material is bent according to the size of the article to be packed, and a second bending groove with a V-shaped slit provided substantially at right angles to the cylindrical portion at a position where the cushioning material is bent according to the size of the article. The first and the second bending grooves are bent to cover the article, so that at least two cylindrical portions are brought into contact with each side of the article.

Japanese Patent Application Laid-Open No. 2001-335024 discloses another cushioning material for packaging configured such that necks of plastic bottles are inserted into a plurality of recesses of thin molded plastic materials, so that the thin molded plastic materials and the plastic bottles are fixed together and arranged between a to-be-packed member and a box.

Japanese Patent Application Laid-Open No. 2003-261179 discloses still another cushioning material for packaging arranged between a cardboard box and an article, and including paper sheet materials, and a plurality of paper pipes attached only to the surface of the peak of a fold of the sheet material. This cushioning material has paper pipes attached to a plurality of pipe mounting regions arranged via the folds.

Japanese Patent Application Laid-Open No. H9-267866 discloses a packaging body formed of laminated paper made of a material that can be easily disposed and has high recyclability, and using a cushioning member having a function of buffering effect. The cushioning member is attached to both sides of a container as a single piece or in a continuous block form corresponding to the gap between the container and the article.

Under such circumstances, the article to be transported is packed generally by forming the cushioning member according to the shape of the article, and under the current circumstances, the cost and time for the investment for equipment and the designing for the packaging material are required for each article. Furthermore, to perform such designing and management, the kinds of parts are increased, and the parts control is complicated accordingly.

Therefore, it is desired to handle various articles having different shapes with fewer types of cushioning materials, which can be used repeatedly. That is, such a form is desired that after the article is delivered to the user, the packaging device is returned to the factory or the like and used repeatedly.

SUMMARY OF THE INVENTION

It is an object of the present invention to at least solve the problems in the conventional technology.

According to an aspect of the present invention, a packaging device includes a bottom plate; a mounting plate arranged above the bottom plate at a specific distance form the bottom plate for mounting an article; a cushioning member arranged in a space between the bottom plate and the mounting plate; and a reinforcing unit arranged on the bottom plate in the space between the bottom plate and the mounting plate, the reinforcing unit including a plurality of reinforcing members arranged at positions that are substantially below points where support members of the article mounted on the mounting plate are located.

According to another aspect of the present invention, a packaging device includes a bottom plate; a plurality of support members arranged on the bottom plate orthogonal to the bottom plate; a first member detachably attached to the bottom plate orthogonal to the bottom plate between two adjoining first support members; a second member firmly attached to the bottom plate orthogonal to the bottom plate between two adjoining second support members that are different from the first support members; a plurality of transverse members attached between a support member of the first support member and adjoining support member of the second support member; a cushioning unit arranged on the bottom plate in a space enclosed by the support members, the cushioning unit including a plurality of airtight containers filled with gas; and a mounting plate arranged above the cushioning unit in the space enclosed by the support members for mounting an article.

According to still another aspect of the present invention, a buffer comprising a cushioning unit arranged between at least one member of an article and a packaging device for packing the article, the cushioning unit including a plurality of box-shaped airtight containers filled with gas.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings.

Figure 1:
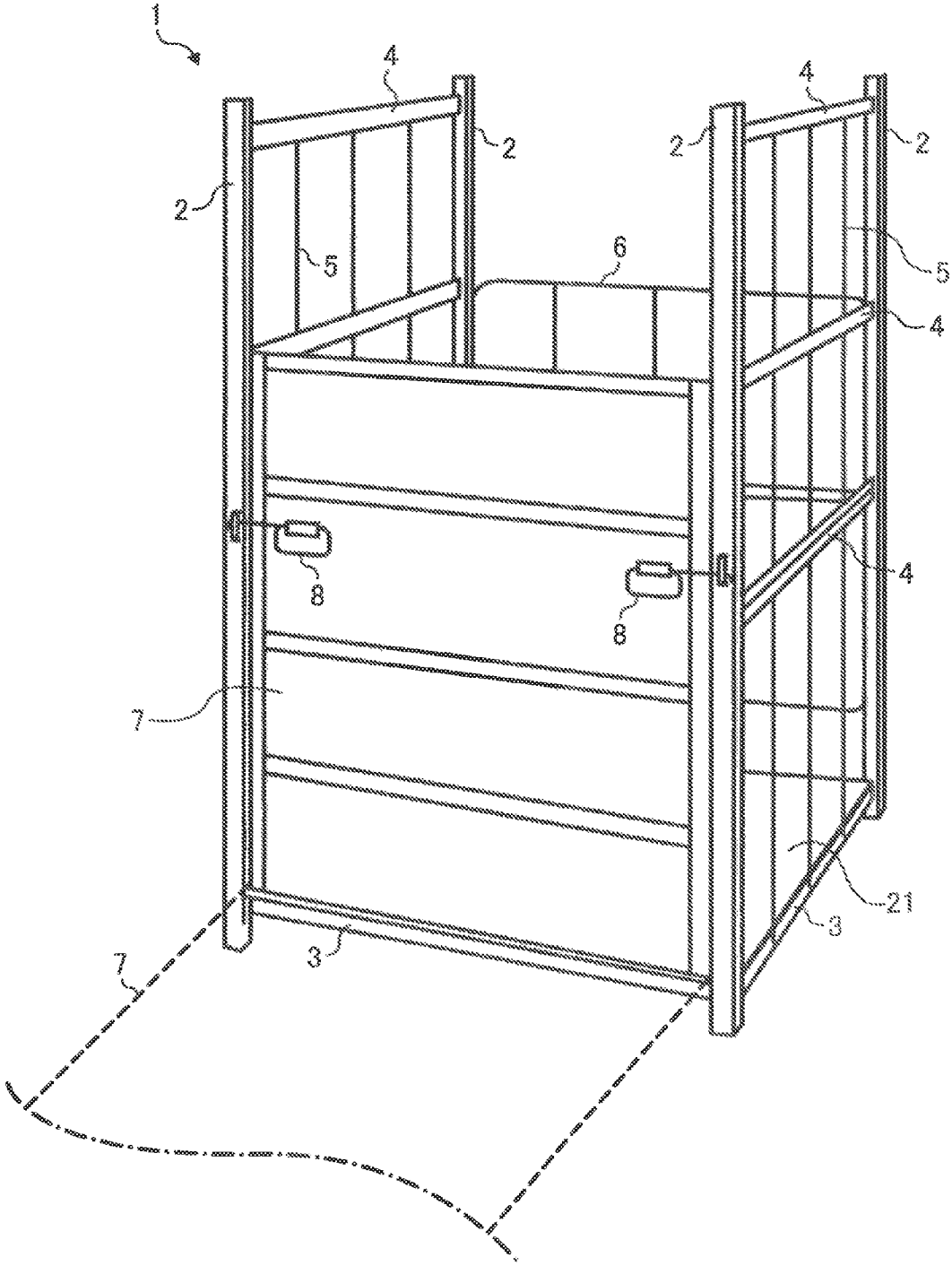
FIG. 1 is a perspective of an example of a packaging device according to a first embodiment of the present invention.

FIG. 1 is a perspective of an example of a packaging device 1 according to a first embodiment of the present invention. The packaging device 1 includes support members 2 arranged at four corners, and a frame member 3 that connects the support members 2 at the bottom. The support member 2 and the frame member 3 are made of iron, and the support members 2 and the frame member 3 are welding. Two adjoining support members 2 are connected by three crosspieces 4 above the frame member 3. The crosspiece 4 is also made of iron, and the support member 2 and the crosspiece 4 are connected by welding. A lattice-like rear member 6 is detachably fitted between the two support members 2 on the back. Reinforcing vertical-pieces 5 are provided parallel to the support members 2 that are connected by the crosspieces 4. The Reinforcing vertical-pieces 5 are connected between the frame member 3 at the bottom and the topmost crosspiece 4. The vertical-pieces 5 are also made of iron, and welded to the frame member 3 and the respective crosspieces 4.

The front side of the packaging device 1 can be opened for loading and unloading a product. That is, a front member 7 arranged between the left and right support members 2, 2 on the front side is supported rotatably by a shaft to the left and right support members 2 at the bottom part, and as shown by a broken line in FIG. 1, the front member 7 can be opened to the front side. When the front member 7 is opened as shown by the broken line, the front member 7 can be used as a slope when the product is unloaded. Locking devices 8, 8 for fixing the front member 7 to the left and right support members 2, 2 at the time of closing the front member 7 are attached to an external surface of the front member 7 (the lower surface when the front member 7 is used as the slope). While the rear member 6 can be fixed, in the first embodiment, it is detachably formed and can be detached, as required when unloading the product. Accordingly, the workability can be improved.

Figure 2:
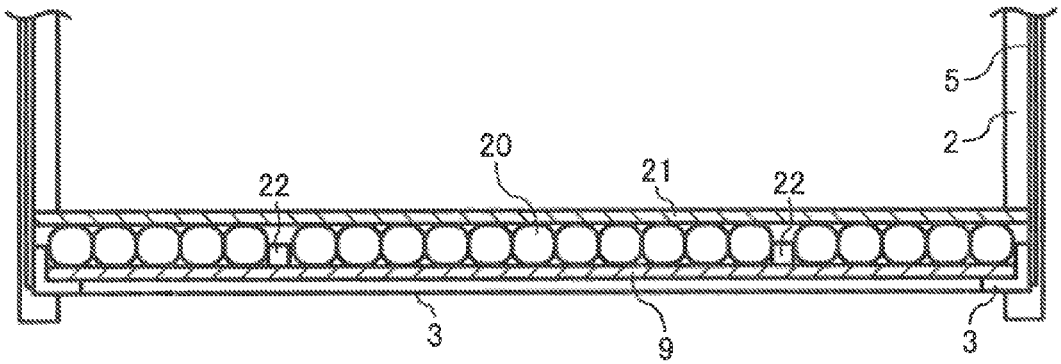
FIG. 2 is a cross section of the configuration near the bottom of the packaging device.

FIG. 2 is a cross section of the configuration near the bottom of the packaging device 1. A bottom base formed of the frame member 3 and a bottom plate 9 is provided near the bottom of the packaging device 1, and the frame member 3 is arranged so as to surround the four corners at the bottom of the packaging device 1. The bottom plate 9 is mounted on a receptacle of the frame member 3. The bottom plate 9 is made of iron and welded to the frame member 3 in the first embodiment. While it is assumed that the frame member 3 is an L-shape member in the example in FIG. 2, an optional material such as a flat plate or a tubular member can be also used.

In the configuration of the conventional packaging device, a product is loaded on the bottom plate. However, when a heavy product is loaded, there is a problem such that the bottom plate can be bent or deformed due to impacts when the product is loaded.

Figure 3:
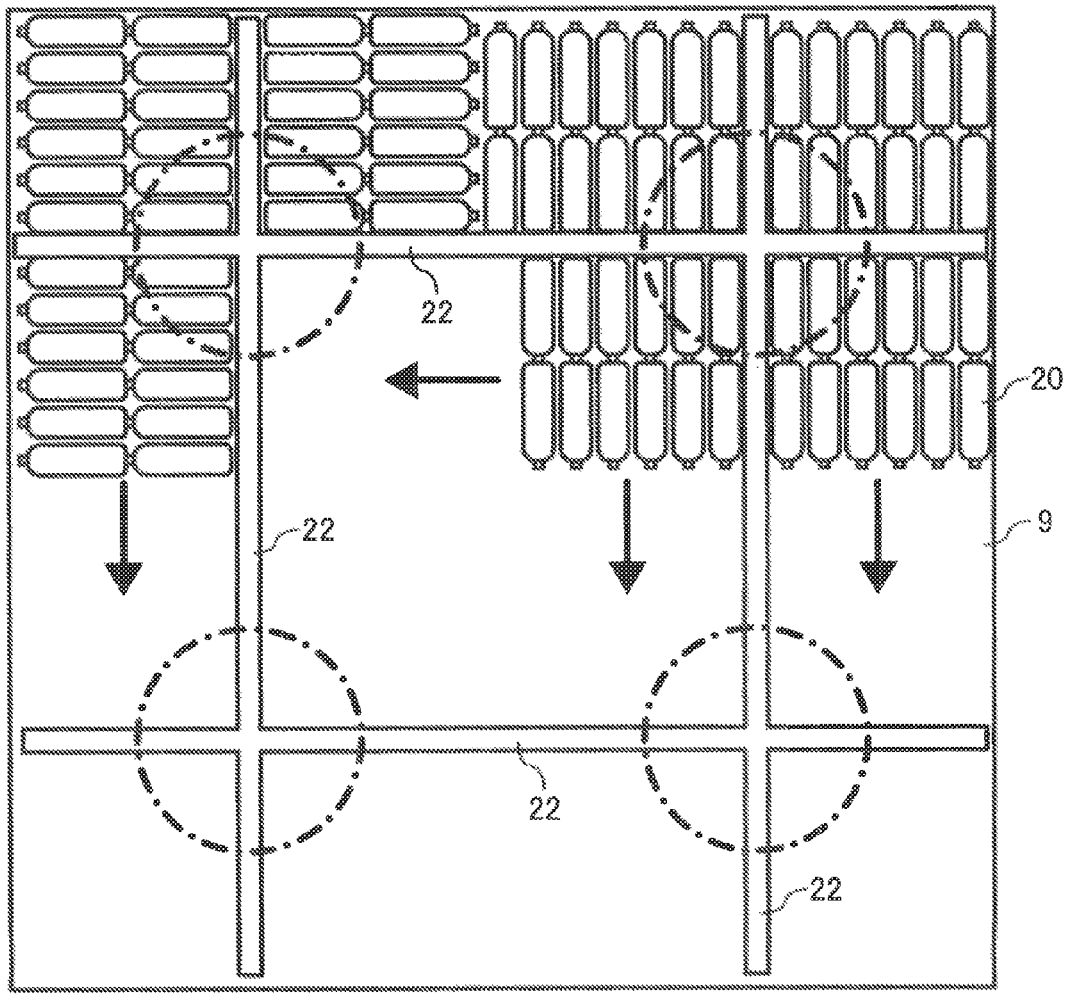
FIG. 3 is a plan view of a state where PET bottles as a cushioning member are arranged on a bottom plate.

Therefore, in the packaging device 1 according to the first embodiment, a cushioning member is provided on the bottom plate 9, and a mounting base 21, which is a base plate for loading the product thereon, is placed on the cushioning member. According to the first embodiment, a reinforced plastic plate is used as the mounting base 21. Empty PET bottles 20 arranged as the cushioning member in the first embodiment. The PET bottles are wasted after the content drink or the like has been consumed. By using the PET bottles as the cushioning member, the cost required for the cushioning member can be largely reduced. Furthermore, the PET bottles 20 can be easily obtained. FIG. 3 depicts a state where the PET bottles as the cushioning member are arranged on the bottom plate 9. In FIGS. 2 and 3, the size of the PET bottles 20 is not necessarily scaled down according to the real ones, and only the state where the PET bottles arranged is shown. The arrangement, number, and the like can be optionally set.

If an impact is applied to the mounting base 21 when the product is loaded on the mounting base 21, or a heavy product, for example, a large-scale copying machine is unloaded, in the configuration in which the cushioning members arranged on the bottom plate 9 and the mounting base 21 is mounted thereon, the impact is dispersed by the cushioning members. Accordingly, it can be prevented that the mounting base 21 or the bottom plate 9 is bent or deformed.

In the packaging device 1 according to the first embodiment, as shown in FIG. 3, a reinforcing member 22 is arranged on the bottom plate 9. When the product loaded on the packaging device 1 is heavy, the product is generally very large. Therefore, the reinforcing member 22 is arranged below a region, where legs of the product (namely, casters of an image forming apparatus, because casters are normally provided when the product is the image forming apparatus) are placed when the product is loaded. That is, the reinforcing member 22 is arranged near the four corners of the mounting base 21 where product support members such as legs or casters of the product are situated.

According to the first embodiment, a double-cross shape reinforcing member 22 is arranged. The reinforcing member 22 is obtained by joining an iron square pipe steel to the bottom plate 9 by welding or the like in the first embodiment. The end of the reinforcing member 22 is joined to the frame 3 by welding or the like. In the packaging device 1 according to the first embodiment, the areas or regions where the casters or legs of the product are placed are shown by circles drawn by a one-dot chain line in FIG. 3. The number of the reinforcing members 22 in the vertical direction and the lateral direction is optional, and more reinforcing members 22 can be provided.

By arranging the reinforcing member 22, the deflection of the mounting base 21 or the bottom plate 9 at the time of loading the product decreases, as compared to the case that there is no reinforcing member 22. Accordingly, it is effective to prevent deformation or damage of the mounting base 21 or the bottom plate 9. Particularly, in the first embodiment, since the reinforcing member 22 is situated below the area (region), to which the product load is applied, it is effective to prevent deformation or damage of the bottom plate 9. Furthermore, since the reinforcing member 22 is situated in two directions (vertical and lateral directions) below the area (region), to which the product load is applied, deformation or damage of the bottom plate 9 can be prevented more reliably.

In the packaging device 1 according to the first embodiment, since the reinforcing member 22 is arranged between the PET bottles 20 as the cushioning member on the bottom plate 9, movements of the PET bottles 20 are suppressed by the reinforcing member 22, thereby efficiently preventing movements of the PET bottles 20 due to impacts when the product is loaded or impacts during transport.

For example, the PET bottles 20 can be arranged as shown in FIG. 3. The bottom of the PET bottles 20 is directed toward the center of the area, so that the caps of the PET bottles 20 are not placed in the area (region), to which the product load is applied. In other words, when the PET bottles 20 are used as the cushioning member in a transverse arrangement, the buffering effect is demonstrated not by the cap but by the body portion. Therefore, the bottle body portions with the buffering effect are arranged in the above area. In other words, by arranging the PET bottles 20 such that the caps are not in the above region, more reliable buffering effect can be demonstrated. Accordingly, even when a heavy product such as a large-scale copying machine is loaded on the packaging device, deformation and damage of the bottom plate 9 can be prevented by effectively dispersing the load applied from the casters of the large-scale copying machine, combined with the arrangement of the reinforcing member 22.

The PET bottles 20 can be arranged, with the longer side of the PET bottle 20 directed toward the vertical direction as shown on the right side in FIG. 3, or with the longer side of the PET bottle 20 directed toward the lateral direction as shown on the left side in FIG. 3, or can be arranged by appropriately combining the both.

Figure 4:
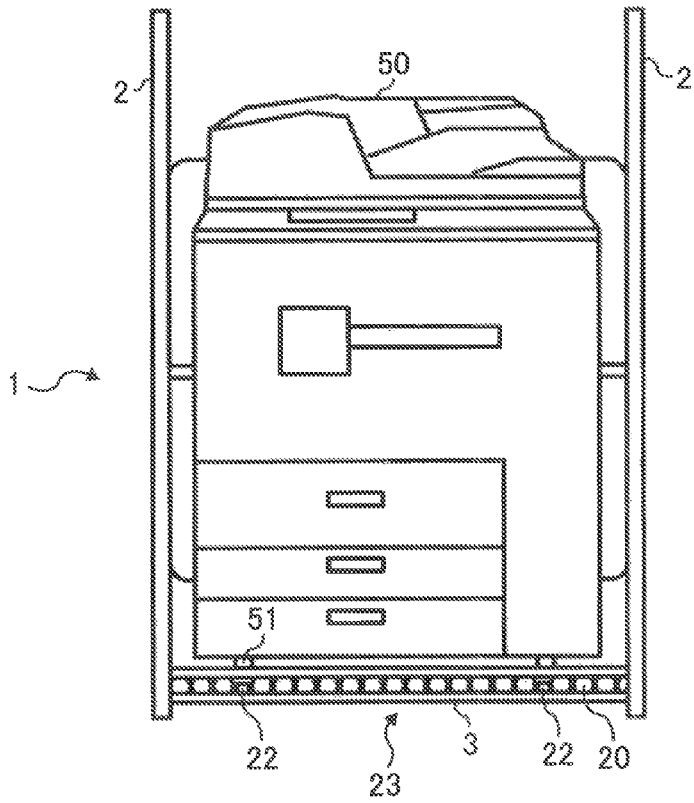
FIG. 4 is a front view of a state where a product is loaded on the packaging device.

FIG. 4 is a front view of a state where a product is loaded on the packaging device 1. A product 50 shown in FIG. 4 is a large-scale copying machine, and an automatic document feeder (ADF), which is an optional device, is mounted on top of the machine main unit. It can be seen that the product 50 has casters 51, and when the product 50 is loaded on the mounting base 21, the reinforcing member 22 is situated below the casters 51. A space 23, into which a forklift arm can be inserted, is formed between the frame member 3 and the floor. In the packaging device 1 according to the first embodiment, the space 23 is also formed on the left and right sides and the rear side, so that the forklift arm can be inserted from four directions of the packaging device 1.

Since the reinforcing member 22 is arranged in an installation space of the cushioning member between the bottom plate 9 and the mounting base 21, there is no increase in the height due to providing the reinforcing member 22, and the height from the floor to the mounting base 21 is suppressed, thereby facilitating the unloading operation of the product. In the packaging device 1 according to the first embodiment, the front member 7 is opened and used as the slope, which makes the inclination of the slope gentle, and facilitates the unloading operation of a heavy product.

Figure 5:
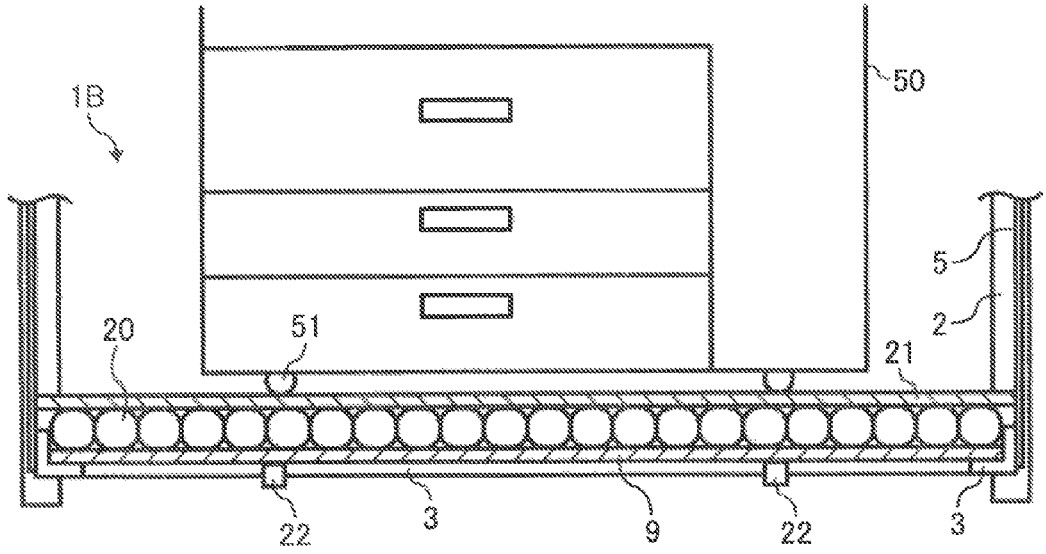
FIG. 5 is a cross section of the configuration near the bottom of a packaging device according to a second embodiment of the present invention.

A second embodiment of the present invention is explained next. FIG. 5 is a cross section of the configuration near the bottom of the packaging device according to the second embodiment. In a packaging device 1B according to the second embodiment, the reinforcing member 22 is joined (welded in the second embodiment) to the underside of the bottom plate 9. The basic configuration except this is the same as the packaging device 1 according to the first embodiment.

In the packaging device 1B according to the second embodiment, since the PET bottles 20 as the cushioning member are present on the reinforcing member 22, in addition to the same effect as that of the packaging device 1 according to the first embodiment, the load at the time of loading the product 50 on the mounting base 21 is dispersed more efficiently and applied to the reinforcing member 22. Accordingly, deformation and damage of the bottom plate 9 can be prevented more efficiently by the reinforcing member 22.

Figure 6:
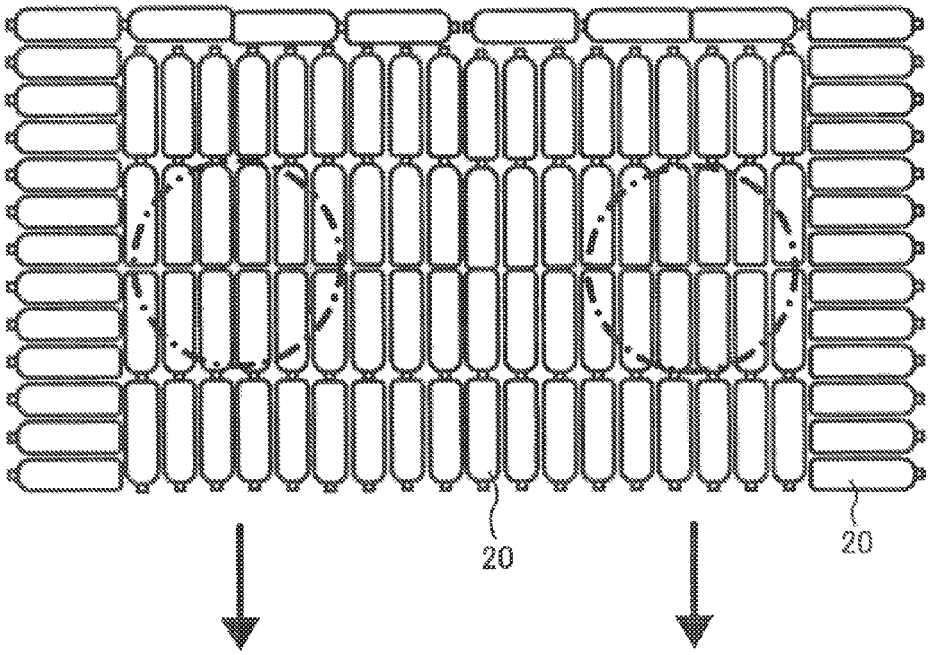
FIG. 6 is a schematic diagram of an arrangement example of PET bottles in the packaging device according to the second embodiment.

According to the second embodiment, since the reinforcing member 22 is provided on the underside of the bottom plate 9, the upper surface of the bottom plate 9 becomes a flat cushioning member arranging space having no obstacle. Therefore, the PET bottles 20 can be arranged without a gap on the bottom plate 9. FIG. 6 depicts (a part of) an arrangement example of the PET bottles 20 in the packaging device 1B according to the second embodiment. As shown in FIG. 6, the PET bottles 20 can be arranged without any gap in the area (region), to which the product load is applied, such that the caps are not arranged n the area. Therefore, the load at the time of loading the product 50 on the mounting base 21 can be efficiently dispersed, and deformation and damage of the bottom plate 9 can be prevented more reliably by the reinforcing member 22.

Figure 7:
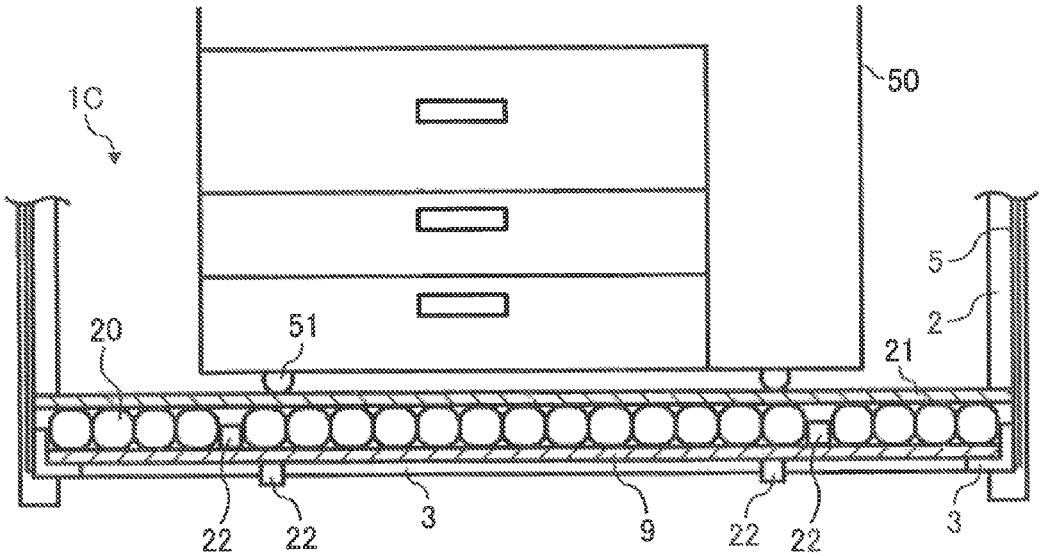
FIG. 7 is a cross section of the configuration near the bottom of a packaging device according to a third embodiment of the present invention.

A third embodiment of the present invention is explained next. FIG. 7 is a cross section of the configuration near the bottom of the packaging device according to the third embodiment. In a packaging device 1C according to the third embodiment, the reinforcing member 22 is joined (welded in the third embodiment) to the upper and lower surfaces of the bottom plate 9. The basic configuration except this arrangement is the same as that of the packaging device 1 according to the first embodiment.

The reinforcing member 22 on the upper and lower surfaces of the bottom plate 9 can be arranged at the same position in the vertical direction (so as to be overlapped as viewed in the vertical direction), or can be arranged at different positions (so as not to be overlapped as viewed in the vertical direction). In the example shown in FIG. 7, the reinforcing members 22 on the upper and lower surfaces of the bottom plate 9 are arranged so as not to be overlapped. Accordingly, the product load can be efficiently dispersed by the reinforcing member 22 on the upper and lower surfaces of the bottom plate. According to the third embodiment, since the reinforcing members 22 are provided on the upper and lower surfaces of the bottom plate 9, the strength of the bottom plate 9 is further increased, and even when a heavy product is loaded thereon, deformation and damage of the bottom plate 9 can be prevented more reliably.

As the arrangement of the PET bottles 20 according to the third embodiment, since there is the reinforcing member 22 on the upper surface of the bottom plate 9, the arrangement of the PET bottles 20 the same as in the packaging device 1 according to the first embodiment can be adopted. In the packaging device 1C according to the third embodiment, as shown in FIG. 7, since there is the reinforcing member 22 below the area (region), to which the product load is applied, deformation and damage of the bottom plate 9 can be prevented effectively. If the PET bottles 20 are arranged just below the casters 51 or the product legs, a better effect can be obtained by absorbing the impact.

In the second and the third embodiments, as in the first embodiment, by arranging the reinforcing member 22 in two directions (vertical and lateral directions) below the area (region), to which the product load is applied, deformation and damage of the bottom plate 9 can be prevented more reliably. The number and the arrangement position of the reinforcing member 22, or the shape and the material of the reinforcing member 22 can be appropriately set. The end of the reinforcing member 22 is joined to the frame member 3 by welding or the like in the respective embodiments.

The first to the third embodiments are not limited to the above arrangement, and for example, the material and the shape of the respective member can be optionally set. Furthermore, the number and the arrangement method of the PET bottles 20 used as the cushioning member are only an example, and the PET bottles 20 can be arranged differently from the example shown in FIGS. 3 and 6. The same applies to the number and the arrangement position of the reinforcing member 22 that reinforces the bottom plate 9. The reinforcing member 22 can be additionally provided so as to surround the circumference of the bottom plate 9 squarely.

Figure 8:
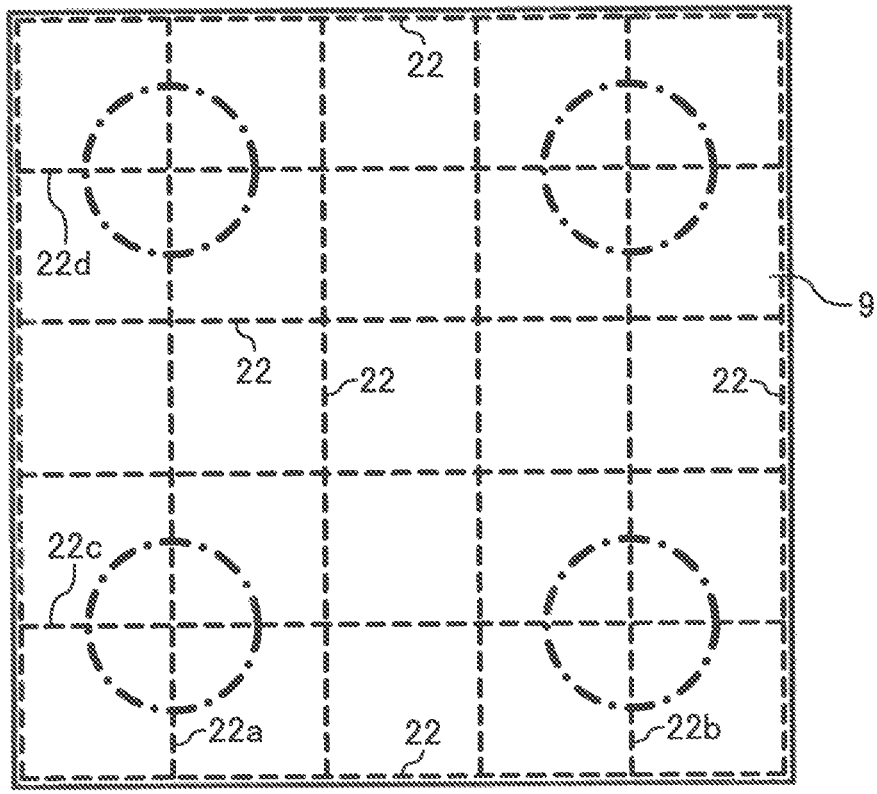
FIG. 8 is a schematic diagram of an arrangement example of reinforcing members.

FIG. 8 depicts an example in which the number of the reinforcing member 22 is increased so as to arrange the reinforcing member 22 also on the circumferential portion. In this example, the reinforcing members 22 are provided on the underside of the bottom plate 9. When the number of the reinforcing member 22 is increased, some of the reinforcing members 22 can be away from the underside of the area (region), to which the product load is applied. In the example shown in FIG. 8, the reinforcing members 22*a* to 22*d* are provided on the underside of the area (region).

The PET bottles 20 as the cushioning member can be square or circle. Cushioning members other than the PET bottles 20 can be also used.

Figure 9A:
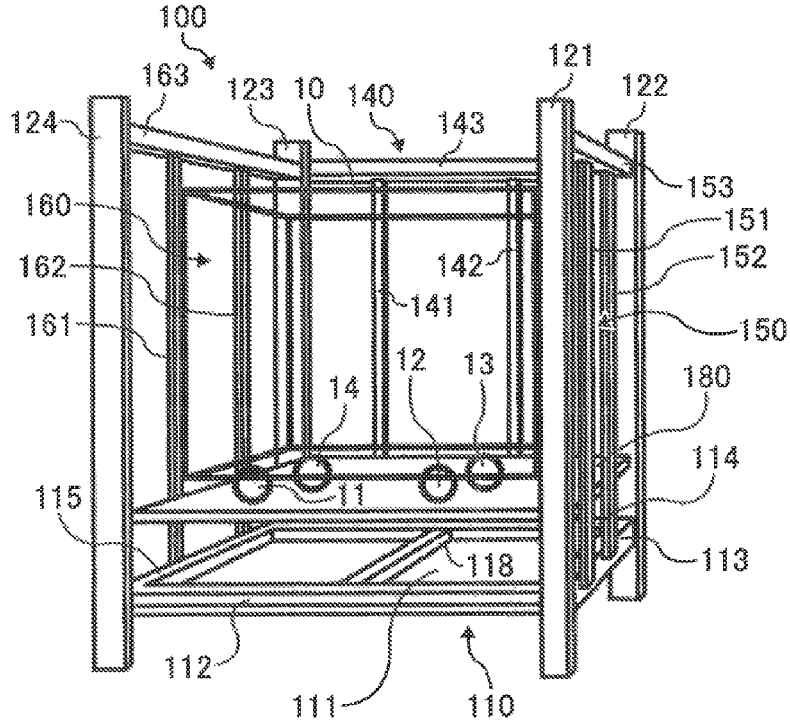
FIG. 9A is a perspective view of a packaging device according to a fourth embodiment of the present invention, depicting a state where a mounting base is lifted.
Figure 9B:
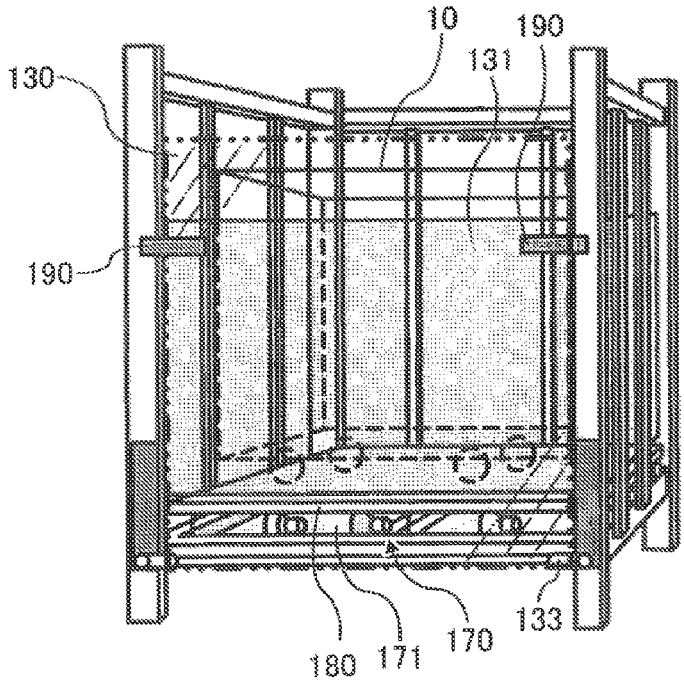
FIG. 9B is a perspective view of the packaging device according to the fourth embodiment, depicting a state where a product is mounted thereon.

A fourth embodiment of the present invention is explained next. FIG. 9A is a perspective view of a packaging device 100 according to the fourth embodiment, depicting a state where a mounting base 180 is lifted. FIG. 9B is a perspective view of the packaging device 100 according to the fourth embodiment, depicting a state where a product is mounted thereon.

Figure 10A:
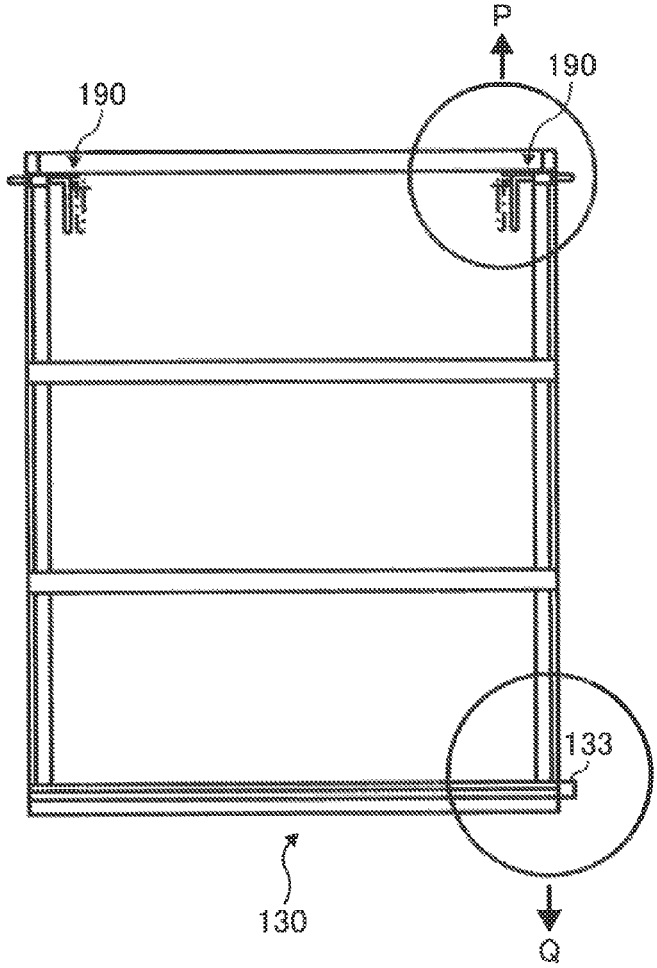
FIG. 10A is a detailed view of a locking device for a front member of the packaging device according to the fourth embodiment, and is an entire view of the front member.
Figure 10B:
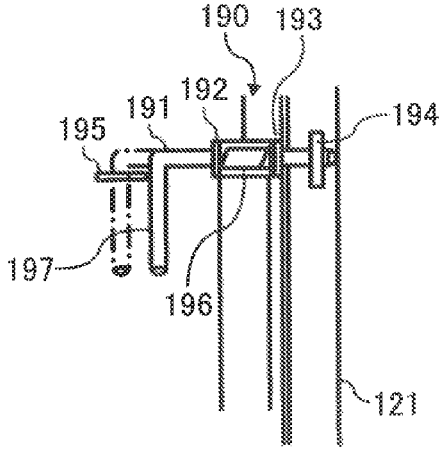
FIG. 10B depicts a locked state of the locking device for the front member of the packaging device according to the fourth embodiment, and is an enlarged view at P in FIG. 10A.
Figure 10C:
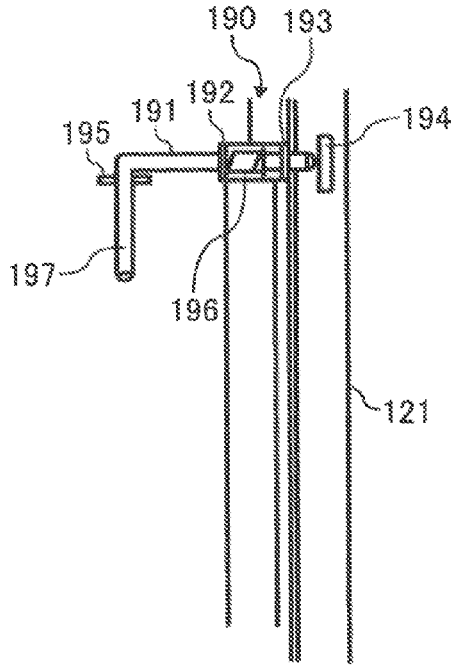
FIG. 10C depicts an unlocked state of the locking device for the front member of the packaging device according to the fourth embodiment, and is an enlarged view at Q in FIG. 10A.
Figure 10D:
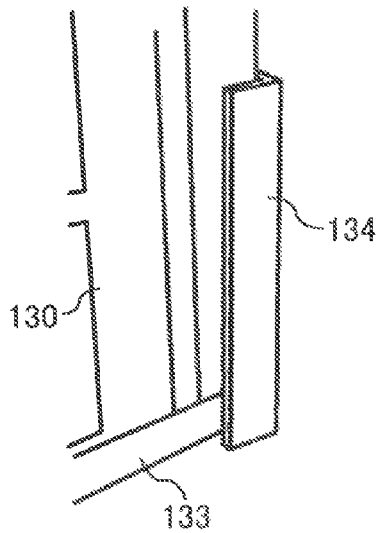
FIG. 10D is an enlarged perspective view of a lower part of the front member in the state that the packaging device according to the fourth embodiment is assembled.

FIG. 10A is a detailed view of a locking device 190 for the front member 130 of the packaging device 100 according to the fourth embodiment, and is an entire view of the front member. FIG. 10B depicts a locked state of the locking device 190 for the front member 130 of the packaging device 100 according to the fourth embodiment, and is an enlarged view at P in FIG. 10A. FIG. 10C depicts an unlocked state of the locking device 190 for the front member 130 of the packaging device 100 according to the fourth embodiment, and is an enlarged view at Q in FIG. 10A. FIG. 10D is an enlarged perspective view of a lower part of the front member 130 in the state that the packaging device 100 according to the fourth embodiment is assembled.

Figure 11:
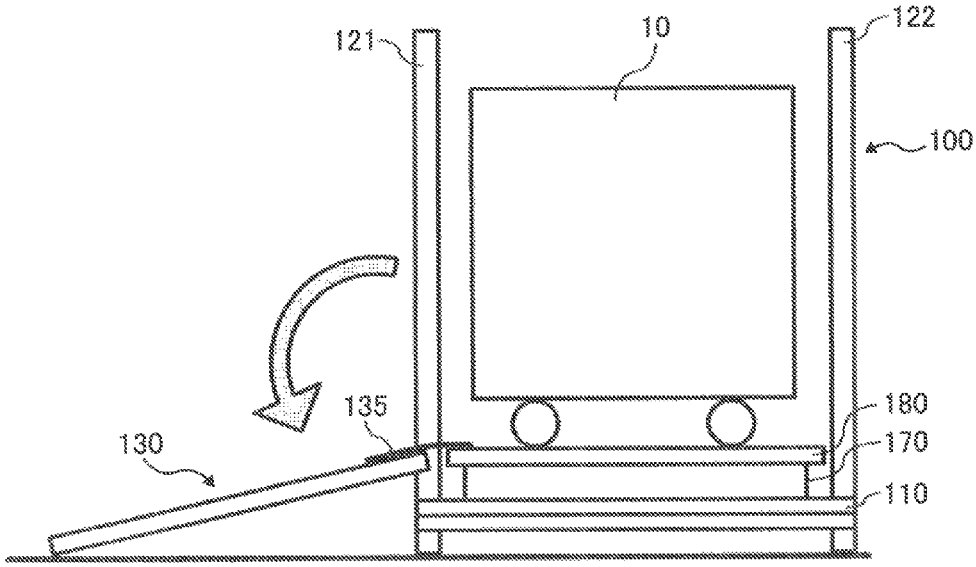
FIG. 11 depicts a state where the front member is used as a tilting support in the packaging device according to the fourth embodiment.

FIG. 11 depicts a state where the front member 130 is used as a tilting support in the packaging device 100 according to the fourth embodiment.

Figure 12A:
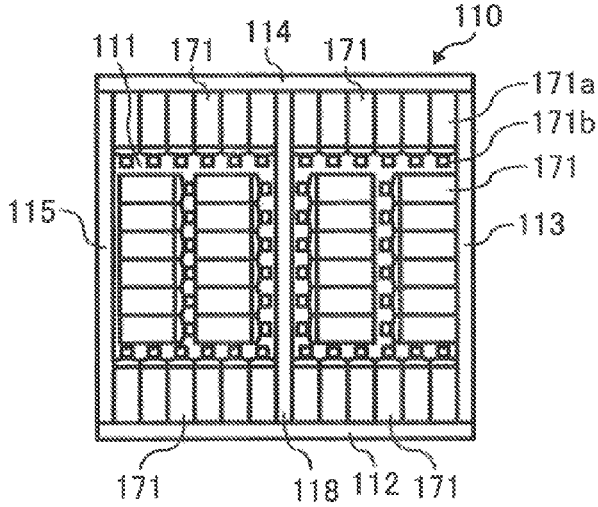
FIG. 12A is a plan view of an arrangement example of PET bottles in the packaging device according to the fourth embodiment.
Figure 12B:
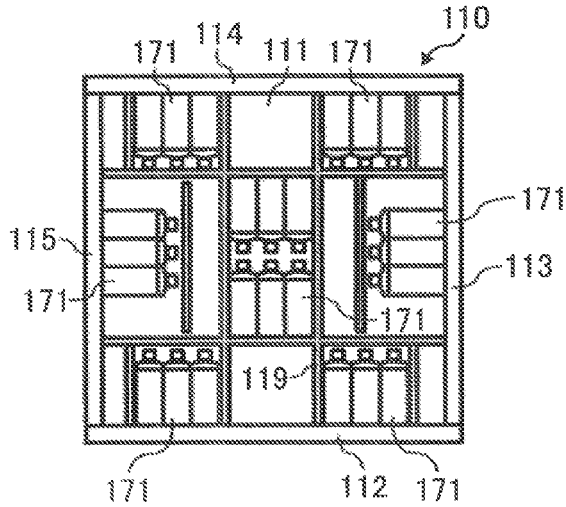
FIG. 12B is a plan view of an arrangement example of the PET bottles in the packaging device according to the fourth embodiment.
Figure 12C:
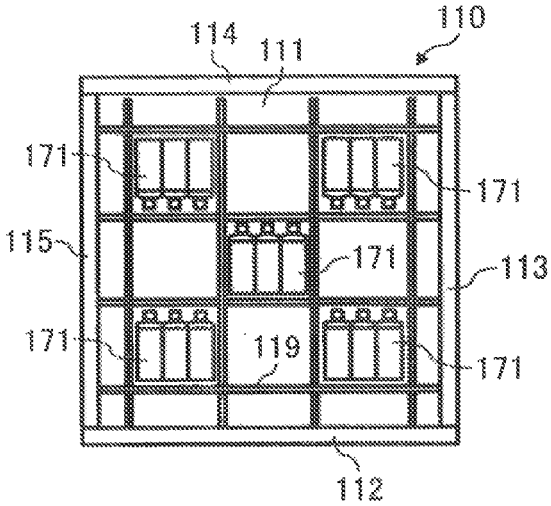
FIG. 12C is a plan view of an arrangement example of the PET bottles in the packaging device according to the fourth embodiment.

FIGS. 12A to 12C are plan views of an arrangement example of PET bottles 171 in the packaging device 100 according to the fourth embodiment.

Figure 13A:
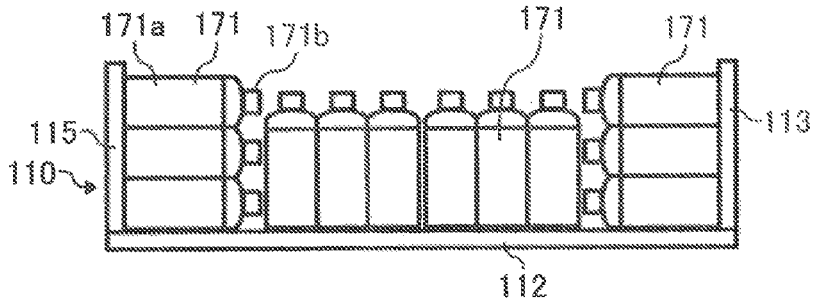
FIG. 13A is a plan view of an arrangement example of the PET bottles in the packaging device according to the fourth embodiment.
Figure 13B:
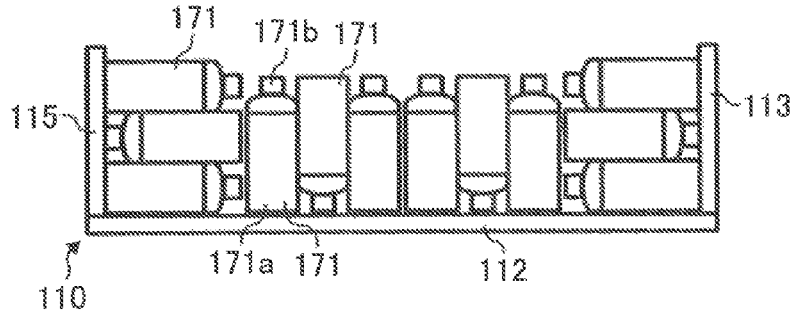
FIG. 13B is a plan view of an arrangement example of the PET bottles in the packaging device according to the fourth embodiment.

FIGS. 13A and 13B are plan views of an arrangement example of the PET bottles 171 in the packaging device 100 according to the fourth embodiment.

In the fourth to the seventh embodiments explained below, the object to be loaded is a copying machine and the cushioning member is the PET bottles. However, the object to be loaded can be anything that requires a buffer with respect to vibrations, impacts, and the like. The cushioning member is not limited to the PET bottles, and various types of cushioning member can be employed, so long as it has the same or similar structure and effect. The cushioning member can be produced for exclusive use. The PET bottle has a bottle shape having a hollow part and a bottom, and is an airtight container having a body having at least one opening, and a closing body detachable from the opening of the body, which closes the opening.

There are various types as the PET bottles used as the cushioning member, including (1) bottles for carbonated beverages (cola, soda, and the like), (2) bottles for high-temperature filled beverages (fruit drink, sports drink, tea, coffee, and the like), (3) bottles for light carbonated beverages, which are subjected to sterilization after filling (light carbonated fruit drink or lactic drink), and (4) bottles for aseptic filling. Furthermore, the external shape or cross section includes circular, square (mainly a square shape with four corners rounded, or a deformed octagon obtained by cutting the four corners and then rounding all corners), and a mixed type of circle and square. Any of these can be employed for the PET bottles used as the cushioning member.

The bottle for carbonated beverages is referred to as a pressure resistant bottle and the like, which can endure internal pressure increased due to the gas generated from the beverages. The bottle for high-temperature filled beverages is used for a beverage not containing carbon dioxide, and is referred to as a heat resistant bottle and the like, whose neck can resist deformation due to the heat when the content is filled. The bottle for light carbonated beverages is referred to as a pressure and heat resistant bottle having both pressure resistant and heat resistant properties. The bottle for aseptic filling is used for a method in which the content and the bottles are separately sterilized before filling, and after the content is filled in a sterile room, the bottles are closed by sterilized caps (aseptic filling), and is referred to as an aseptic bottle or the like, and every bottle is normally transparent.

The packaging device 100 according to the fourth embodiment packs, as shown in FIGS. 9A and 9B, the product 10, and casters 11, 12, 13, and 14 are fitted to the product 10. The packaging device 100 is formed of a bottom base 110 and four support members 121, 122, 123, and 124 arranged in an upright manner at four corners of the bottom base 119 and formed as legs of the bottom base 110. Furthermore, the packaging device 100 includes a front member 130 detachably fitted to the bottom base 110 to form a front wall, a rear member 140 attached to the bottom base 110 to form a rear wall, a transverse member 150 attached to the bottom base 110 to form a right side wall, a transverse member 160 attached to the bottom base 110 to form a left side wall, a cushioning member 170 formed of the PET bottles 171, which are airtight containers arranged on the bottom base 110 filled with gas, and a mounting base 180 arranged on the cushioning member, on which an article is mounted.

In the packaging device 100 according to the fourth embodiment, a rocking locking device 190 that fixes the front member 130 to the support members 121 and 124 is provided between the front member 130, and the support members 121 and 124.

The bottom base 110 is made of a steel material, and formed of a bottom plate 111 and frame members 112, 113, 114, and 115 provided at the four corners of the bottom plate 111. The support members 121, 122, 123, and 124 formed of a square pipe is arranged in an upright manner at the four corners of the bottom base 110.

The lower part of the support members 121, 122, 123, and 124 protrude downward from the bottom plate 111 to form legs. Therefore, a space for inserting the fork of a forklift is formed below the bottom base 110.

The bottom base 110 includes the cushioning member 170 in which the PET bottles 171 are regularly arranged, and the flat mounting base 180 is arranged on the cushioning member 170. A product 10 is mounted on the mounting base 180 and packed. It is desired that the mounting base 180 be formed of a hard material having rigidity and moderate elasticity such as resin. Therefore, by using a hard material for the mounting base 180, the load of the product 10 is dispersed to the PET bottles 171 in a wide area, thereby obtaining moderate cushioning performance. By using a hard material for the mounting base 180, the loading surface of the product 10 is smoothed, thereby smoothing unloading of the product 10. Furthermore, a metal, wood, or the like can be used for the mounting base 180, other than the resin.

According to the fourth embodiment, partitions 118 are arranged, as shown in FIG. 12A, on the bottom plate 111 of the bottom base 110, and the PET bottles 171 are arranged on the whole surface of the partitioned bottom plate 111 in a predetermined pattern. As shown in FIG. 12B, a plurality of partitions 119 can be arranged in a predetermined pattern, as required, so that the PET bottles 171 are arranged in an appropriate pattern, separated from each pattern, or, as shown in FIG. 12C, the PET bottles 171 can be arranged so as to agree with the position of casters 11, 12, 13, and 14 of the product 10. At this time, the arrangement direction of a container body 171*a* and a cap 171*b* of the PET bottles 171 are the same.

FIG. 13A depicts another example in which the PET bottles 171 are arranged in the same direction. FIG. 13B depicts another example in which the arrangement direction of the container 171*a* and the cap 171*b* of the PET bottles 171 is made alternate.

In FIG. 9A, a crosspiece 153 forming the right transverse member 150 and two vertical-pieces 151 and 152 connecting the crosspiece 153 and the frame member 113 are provided between the support members 121 and 122.

Furthermore, a crosspiece 143 forming the rear member 140 and two vertical-pieces 141 and 142 connecting the crosspiece 143 and the frame member 114 are provided between the support members 122 and 123.

Likewise, a crosspiece 163 forming the left transverse member 160 and two vertical-pieces 161 and 162 connecting the crosspiece 163 and the frame member 115 are provided between the support members 123 and 124.

The front member 130 includes a shaft 133, as shown in FIGS. 10A, 10D, and 11, so that the front member 130 can be rotated and used as the tilting table used for unloading the product 10, with one end thereof being put on the bottom base 110. As shown in FIG. 10D, a shaft guide 134 is welded to the support members 121 and 124. When the packaging device 100 is assembled, by fitting the shaft 133 of the front member 130 to the shaft guide 134, the front member 130 can be rotated in a back and forth direction. In FIG. 11, reference numeral 135 denotes a cover member arranged on a gap between the mounting base 180 and the front member 130.

The front member 130 and the support members 121 and 124 include, as shown in FIGS. 10A, 10B, and 10C, the locking device 190 that locks the front member 130 to the support members 121 and 124. According to the fourth embodiment, as shown in FIGS. 10B and 10C, the locking device 190 supports a handle 191 slidably and rotatably by supports 192 and 193, so that the handle 191 is put in and out from a hole in a lock plate 194 provided in the support member 121. Reference numeral 195 in FIGS. 10A and 10B denotes a handle fixing member, 196 denotes a handle member pushing spring, and 107 denotes a holding part of the handle.

By such a locking device 190, the front member 130 can be switched to a locked state (FIG. 10B) or an unlocked state (FIG. 10C) with respect to the support members 121 and 124.

According to the packaging device 100 of the fourth embodiment, not only impact to the product 10 that can happen during transport is eased by the cushioning member, but also the packaging device 100 can be used several times. Accordingly, the investment for a plant and equipment, the cost, and the time for packaging can be reduced, and parts control and the like can be facilitated.

Furthermore, since the mounting base 180 can be formed by using the PET bottles 171 or materials having a similar shape to that the PET bottles 171, the PET bottles 171 and the like can be reused instead of disposing them as waste.

A fifth embodiment of the present invention is explained below.

Figure 14:
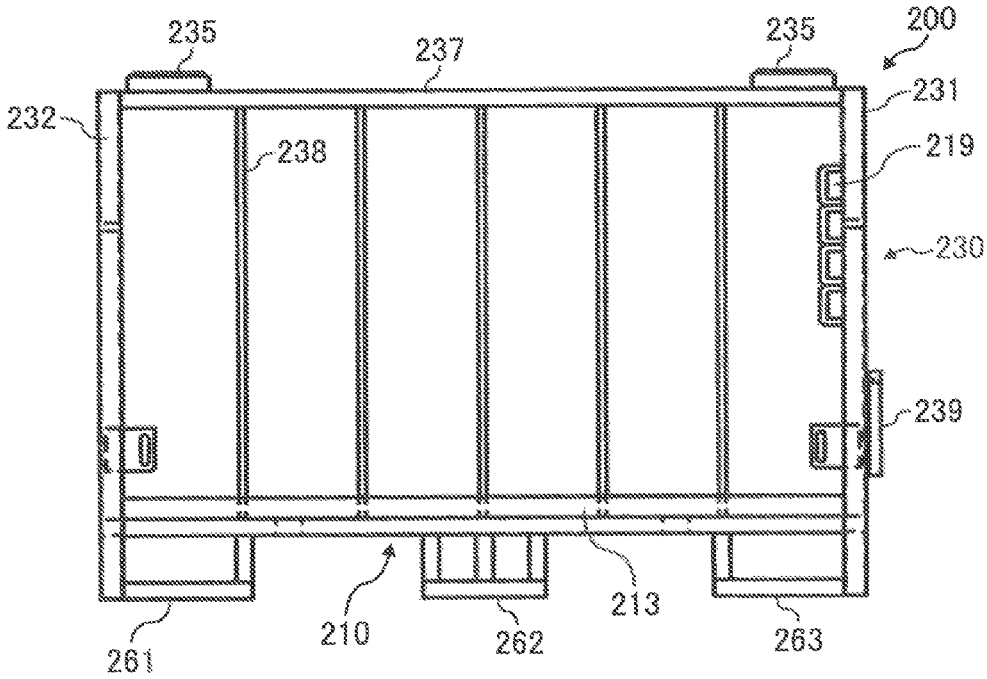
FIG. 14 is a side view of a bottom base of a packaging device according to a fifth embodiment of the present invention.
Figure 15:
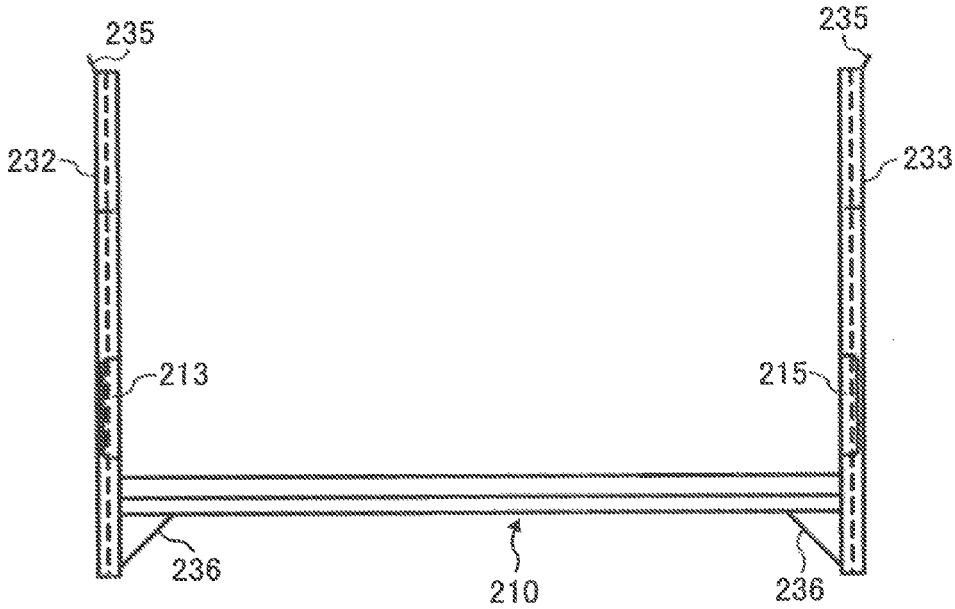
FIG. 15 is a front view of the bottom base of the packaging device according to the fifth embodiment.
Figure 16:
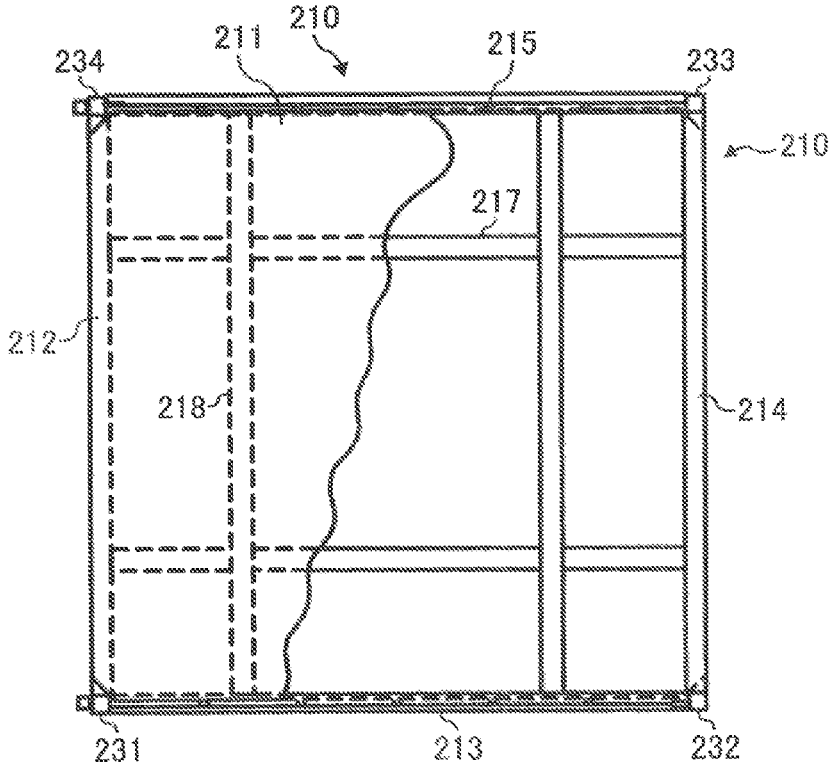
FIG. 16 is a plan view of the bottom base of the packaging device according to the fifth embodiment.

FIG. 14, FIG. 15, and FIG. 16 are, respectively, a side view, a front view, and a plan view of a bottom base 210 of a packaging device 200 according to the fifth embodiment.

Figure 17A:
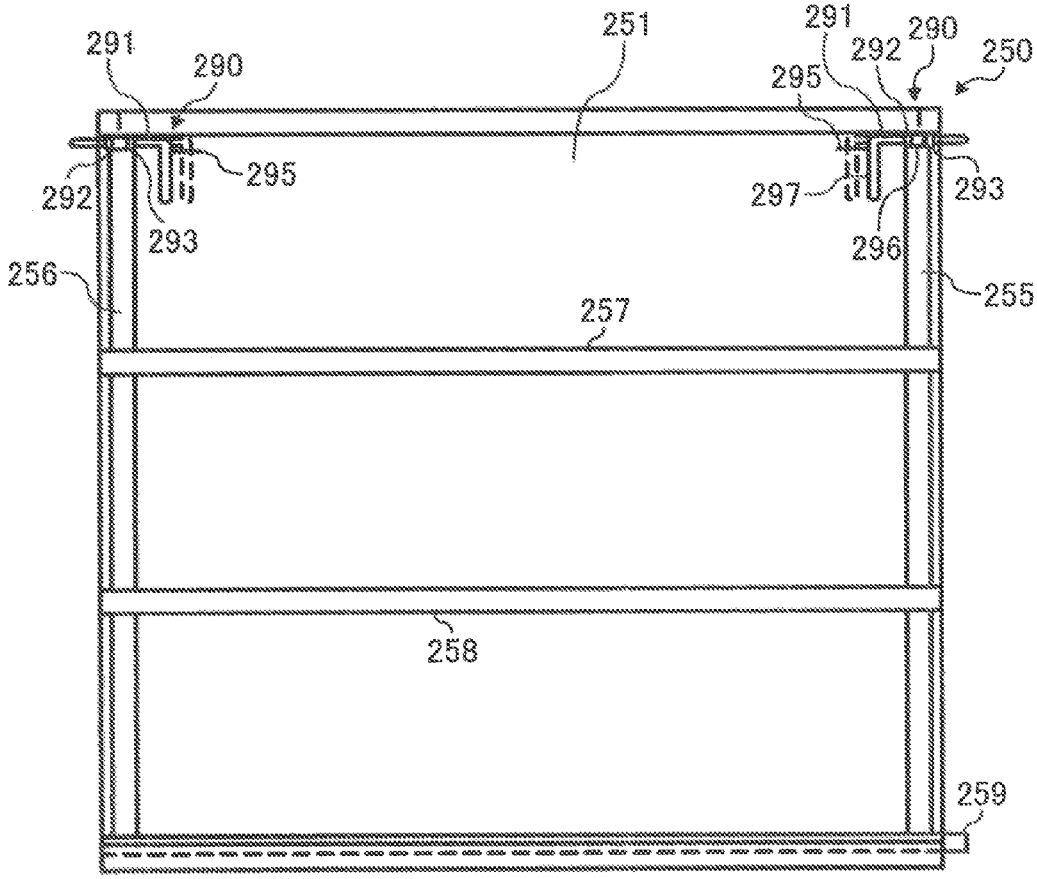
FIG. 17A is a front view of a front member of the packaging device according to the fifth embodiment.
Figure 17B:
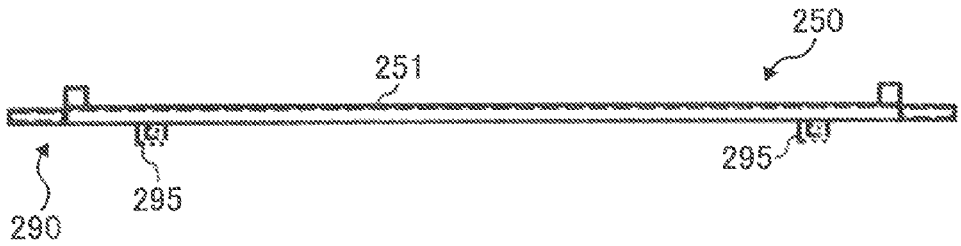
FIG. 17B is a plan view of the front member of the packaging device according to the fifth embodiment.

FIGS. 17A and 17B are, respectively, a front view and a plan view of a front member 250 of the packaging device 200 according to the fifth embodiment.

Figure 18A:
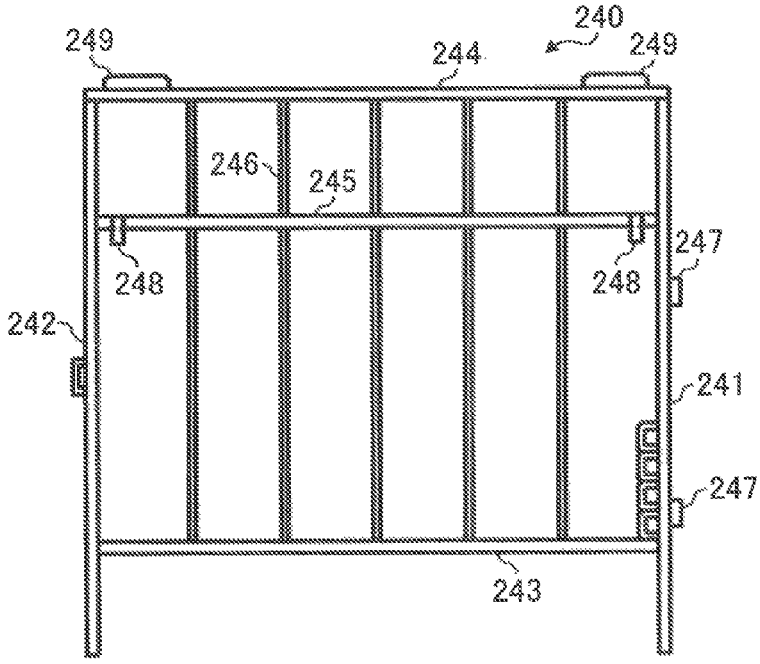
FIG. 18A is a front view of a transverse member of the packaging device according to the fifth embodiment.
Figure 18B:
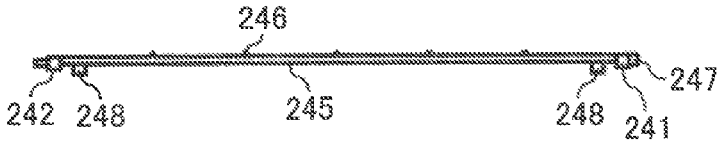
FIG. 18B is a plan view of the transverse member of the packaging device according to the fifth embodiment.
Figure 18C:
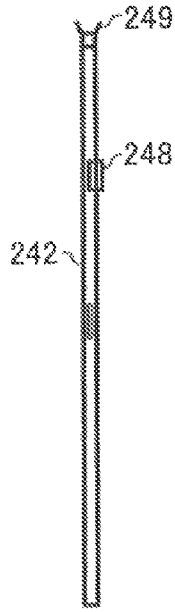
FIG. 18C is a side view of the transverse member of the packaging device according to the fifth embodiment.

FIG. 18A, FIG. 18B, and FIG. 18C are, respectively, a front view, a plan view, and a side view of a transverse member 240 of the packaging device 200 according to the fifth embodiment.

Figure 19A:
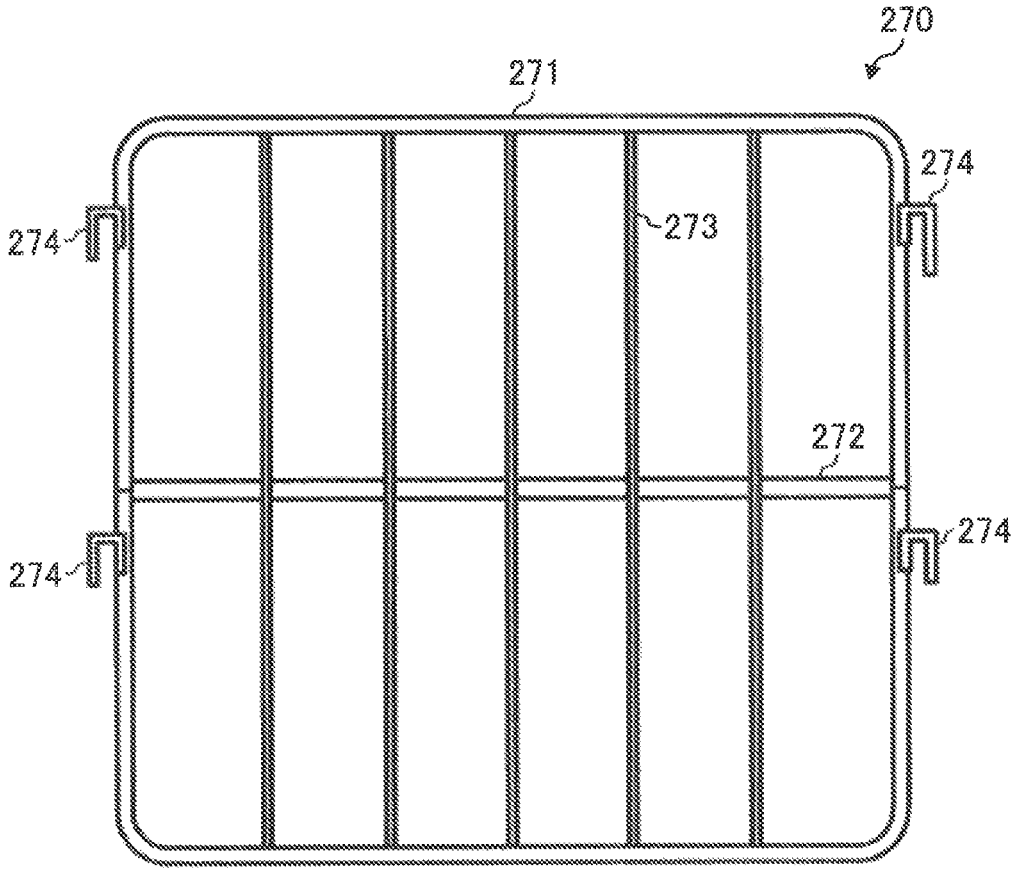
FIG. 19A is a back view of a rear member of the packaging device according to the fifth embodiment.
Figure 19B:
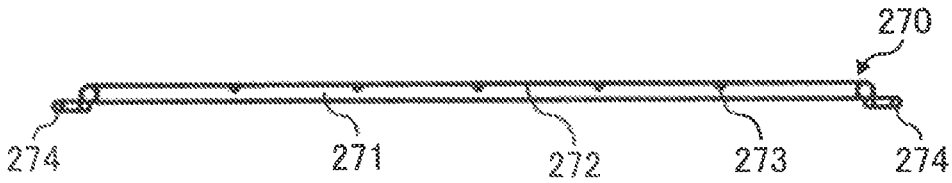
FIG. 19B is a cross section of the rear member of the packaging device according to the fifth embodiment.

FIGS. 19A and 19B are, respectively, a back view and a cross section of a rear member 270 of the packaging device 200 according to the fifth embodiment.

Figure 20A:
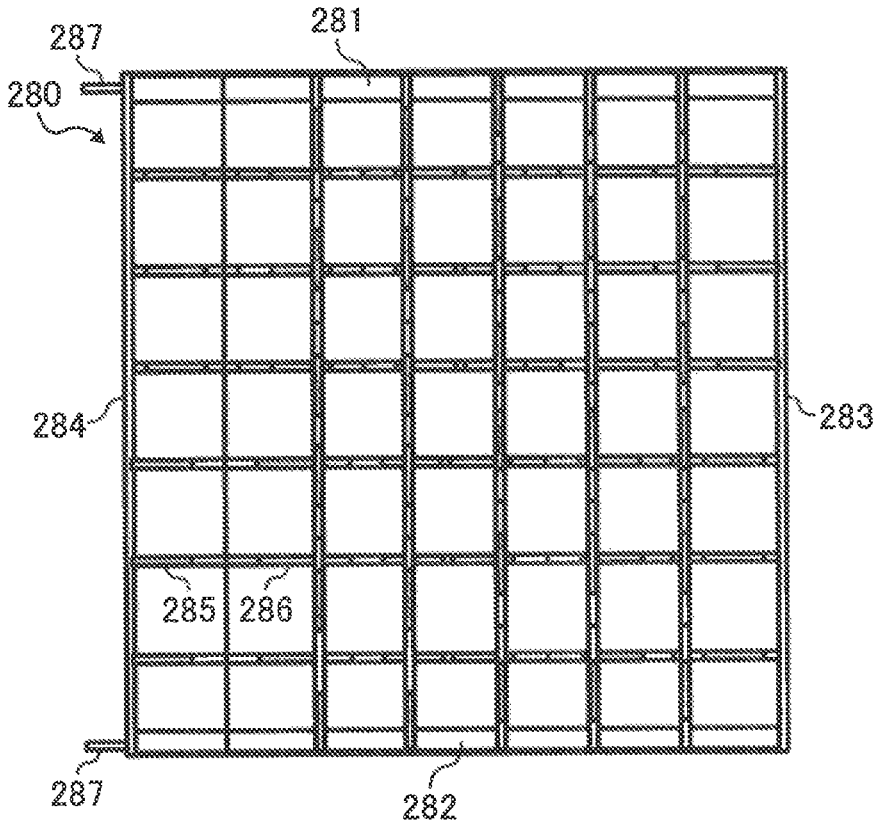
FIG. 20A is a plan view of a top panel member of the packaging device according to the fifth embodiment.
Figure 20B:
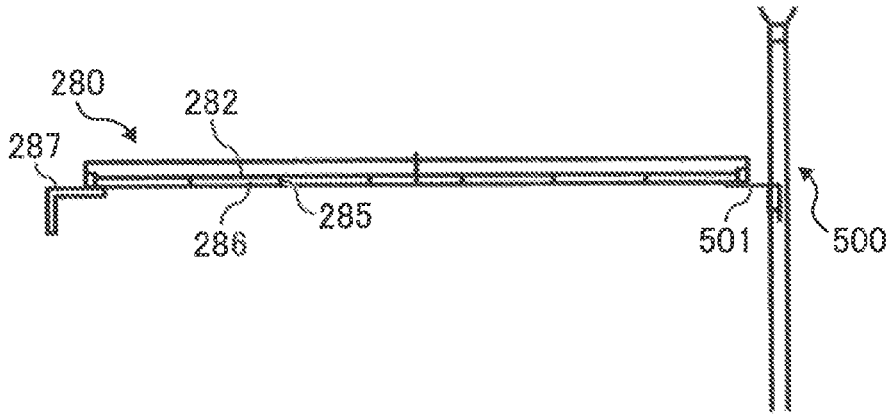
FIG. 20B is a side view of the top panel member of the packaging device according to the fifth embodiment.

FIGS. 20A and 20B are, respectively, a plan view and a side view of a top panel member 280 of the packaging device 200 according to the fifth embodiment.

The packaging device 200 according to the fifth embodiment is made of steel, and includes a bottom base 210, a lower transverse member 230, an upper transverse member 240, the front member 250, the rear member 270, and the top panel member 280. According to the fifth embodiment, the left and right upper transverse members 240, the front member 250, the rear member 270, and the top panel member 280 are constructed so as to be able to be assembled or disassembled with respect to the bottom base 210. According to the fifth embodiment, the configurations of the mounting base and the cushioning member are the same as in the fourth embodiment, and hence, the explanation thereof is omitted.

In the bottom base 210, as shown in FIGS. 14, 15, and 16, frame members 212, 213, 214, and 215 are arranged at four sides of a square bottom plate 211, and reinforcing members 217 and 218 are arranged in a double-cross shape on the underside of the bottom plate 211. According to the fifth embodiment, legs 261, 262, and 263 are arranged below the bottom base to form a fork insertion portion for the forklift. Reference numeral 236 in FIG. 15 denotes a corner plate for reinforcement.

According to the fifth embodiment, the support member includes lower pillar members 231, 232, 233, and 234 arranged on the bottom base 210, and two pairs, in total, four upper pillar members 241 and 242 (two upper pillar members forming the right transverse member are not shown in the drawings, and hence reference numeral therefor is omitted) forming the upper transverse member 240 provided detachably on the lower pillar members.

The right lower transverse member includes a lower transverse member 230 provided between the lower pillar members 231 and 232 on the bottom base 210 and the detachable upper transverse member 240. The left lower transverse member is formed in the same manner.

The lower pillar members 231, 232, 233, and 234 made of a square pipe are arranged in a standing condition at the four corners of the bottom base 210. The lower pillar members 231, 232, 233, and 234 form a lower part of the support member arranged at four corners of the packaging device 200.

The lower transverse member 230 includes a beam 237 provided between the upper ends of the lower pillar members 231 and 232, and five linear members 238 provided between the beam 237 and the frame member 213. Reference numeral 239 in FIG. 14 denotes a fixing pipe for fixing the rear member 270, 219 denotes a belt fixing unit that fixes a belt for fixing the product, and 235 denotes a guide plate of the upper transverse member 240. The guide plate 235 plays a guiding role at the time of piling the bottom base 210.

The front member 250 is formed, as shown in FIGS. 17A and 17B, by arranging the reinforcing members 255 and 256 at the four corners of a rectangular plate 251, and also arranging two reinforcing crosspieces 257 and 258 in the horizontal direction. A shaft member 259 is provided on a lower part of the front member 250, which serves as an axis of rotation when the front member 250 is rotated and used as the tilting table. A locking device 290 that fixes the front member 250 is provided on an upper part of the front member 250. The locking device 290 in the fifth embodiment has the same configuration as that of the fourth embodiment, and includes a handle 291, supports 292 and 293, a handle fixing member 295, a handle member pushing spring 296, and a holding part 297 of the handle.

The upper transverse member 240 is formed, as shown in FIGS. 18A, 18B, and 18C, by providing crosspieces 244, 245, and 243 on the upper, middle, and lower levels between the upper pillar members 241 and 242, and arranging the five linear members 246 in the vertical direction. According to the fifth embodiment, the lower parts of the upper pillar members 241 and 242 are inserted into the lower pillar members 231 and 232 and fixed, to form the transverse member together with the lower transverse member 230. Reference numeral 247 in FIG. 18A denotes a fitting guide for fitting the rear member 270, and 248 denotes a fitting guide for fitting the top panel member 280.

As shown in FIG. 20B, a locking step 501 in a flange form for mounting the top panel member 280 is provided on the right upper transverse member 500, instead of the fitting guide 248.

The rear member 270 is formed, as shown in FIGS. 19A and 19B, by providing a crosspiece 272 to a frame 271 obtained by forming a round bar substantially in an annular square, and arranging five linear members 273 in the vertical direction between the upper and lower sides of the frame 271. Reference numeral 274 denotes a hook portion inserted into the fitting guide 247 of the upper transverse member 240.

The top panel member 280 is formed of, as shown in FIGS. 20A and 20B, frames 281, 282, 283, and 284 forming four sides, and linear members 285 and 286 provided between the opposing frames so as to form a lattice-like shape. According to the fifth embodiment, the frame 284 includes an engagement member 287 inserted into the fitting guide 248 of the upper transverse member 240. According to the fifth embodiment, the engagement member 287 of the top panel member 280 is engaged with the fitting guide 248 of the upper transverse member 240. On the other side, the top panel member 280 is mounted on the locking step 501 provided on the upper transverse member 500.

According to the packaging device 200 of the fifth embodiment, in addition to the functional effect of the packaging device 100 according to the fourth embodiment, with an unpacked state of the product 10, the front member 250, the rear member 270, the transverse member 240, and the top panel member 280 detached from the bottom base 180 can be mounted on the mounting base 180, thereby achieving a compact form.

A sixth embodiment of the present invention is explained next. In the sixth embodiment, the packaging device 100 according to the fourth embodiment and the packaging device 200 according to the fifth embodiment pack the product 10 by using a buffer 300.

Figure 21:
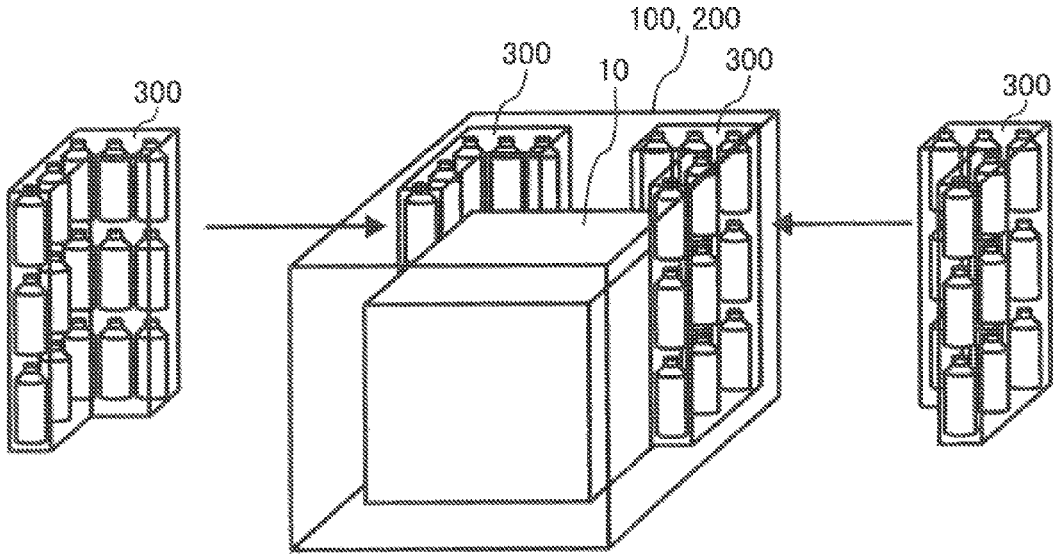
FIG. 21 is a perspective view of a packaging example using a buffer according to a sixth embodiment of the present invention.
Figure 22A:
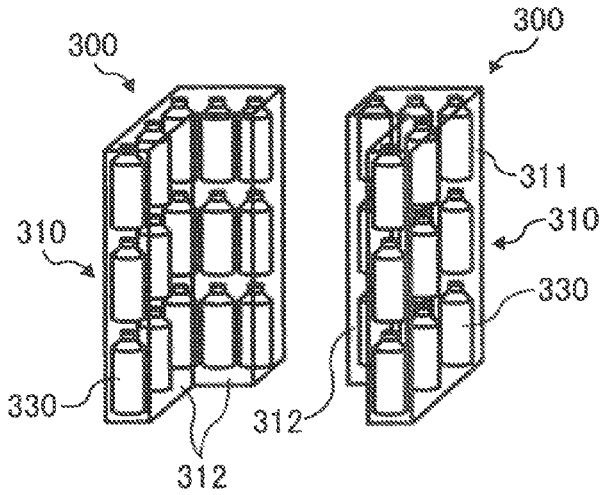
FIG. 22A is a perspective view of the buffer shown in FIG. 21.
Figure 22B:
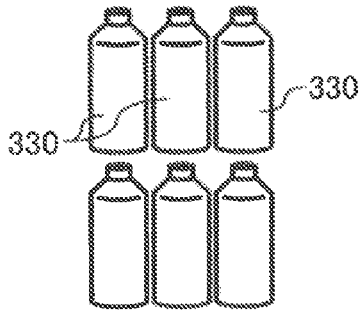
FIG. 22B is a layout view of PET bottles in the buffer shown in FIG. 21.

FIG. 21 is a perspective view of a packaging example using the buffer 300 according to the sixth embodiment. FIG. 22A is a perspective view of the buffer 300 shown in FIG. 21. FIG. 22B is a layout view of PET bottles 330 in the buffer 300 shown in FIG. 21.

Figure 23:
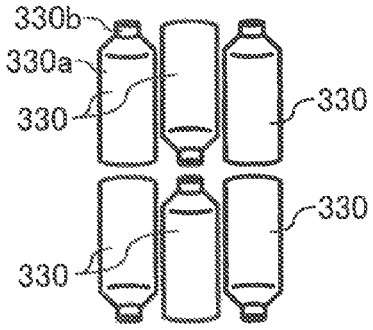
FIG. 23 is a layout view of PET bottles in a buffer according to another example.

FIG. 23 is a layout view of the PET bottles 330 in the buffer according to another example.

Figure 24A:
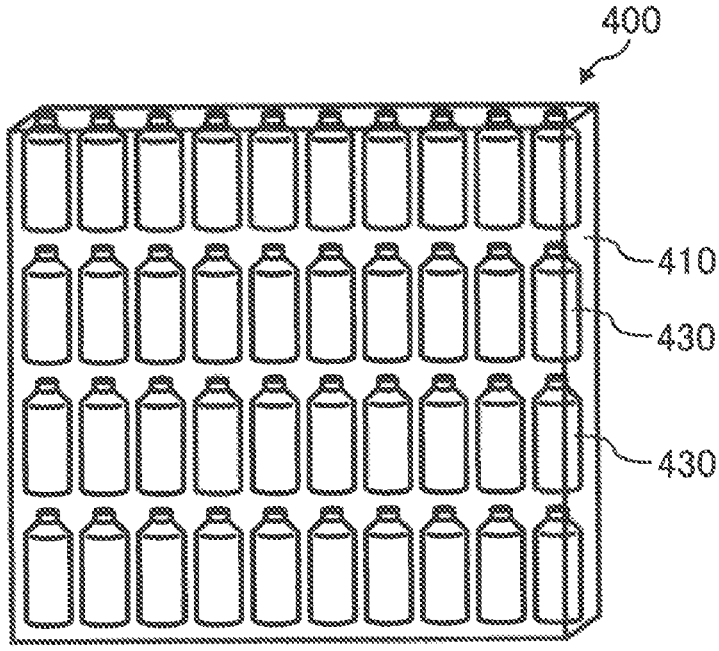
FIG. 24A is a perspective view of the buffer according to the another example.
Figure 24B:
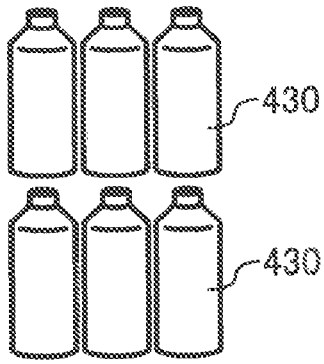
FIG. 24B is a layout view of the PET bottles in the buffer according to the another example.

FIG. 24A is a perspective view of the buffer 300 according to another embodiment. FIG. 24B is a layout view of the PET bottle 330 in the buffer 300 according to the another example.

Although the bottles have been shown to be arranged with gaps therebetween in the figures, it is not limited to such arrangement. The bottles can also be arranged without any gap between vertically or horizontally adjacent bottles.

As the packaging device according to the sixth embodiment, the packaging devices 100 and 200 shown in the fourth and the fifth embodiments can be used.

According to the sixth embodiment, as shown in FIGS. 21, 22A and 22B, the buffer 300 arranged between the two transverse members of the packaging device 100 (200) and the product 10 is used as a packaging body. The buffer 300 is formed by arranging a plurality of PET bottles 330, which is an airtight container in which gas is sealed up in a hollow box-like member 310. The shape and the like of the PET bottle 330 is the same as in the fourth embodiment, therefore, the explanation thereof is omitted.

According to the sixth embodiment, the box-like member 310 is formed by notching and bending one plate made of synthetic resin, for example, a plastic cardboard material. The box-like member 310 includes, as shown in FIG. 22A, a bifacial outside corner contact portion 311, with which two inner surfaces of the packaging device 100 (200) with a box-like shape come in contact, and a bifacial inside corner contact portion 312, which comes in contact with a corner of the product 10, and is formed substantially in an L shape.

Figure 25A:
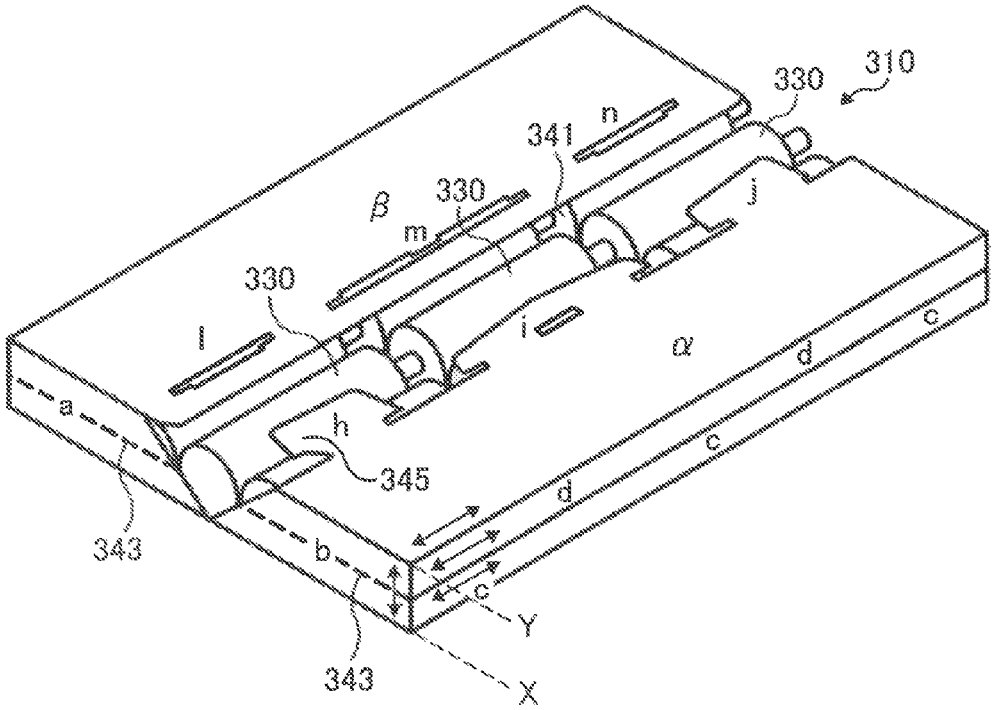
FIG. 25A is a perspective view of a box-like member of a buffer.

As shown in FIG. 25A, the box-like member 310 is formed substantially in an L shape by bending a box-like member having an opening 341 for bending at the center, before bending. According to the sixth embodiment, the box-like member is formed so that the PET bottles 330 can be inserted from the opening 341. In other words, according to the sixth embodiment, the PET bottles 330 can be inserted in two rows on one ($\alpha$) side of the box-like member 310 divided at the center, two rows on the other ($\beta$) side, and one row in-between, and one row can accommodate three PET bottles. The box-like member 310 is then bent to form substantially an L shape, while protrusions h, I, and j formed on a surface $\alpha$ are inserted into slits l, m, and n on a surface $\beta$, and engaged therewith. At the time of bending, the PET bottles 330 in the middle row rotate, so that the other two rows on the opposite sides are lined up accordingly, so as not to move in pieces. Accordingly, the workability is not deteriorated.

Figure 25B:
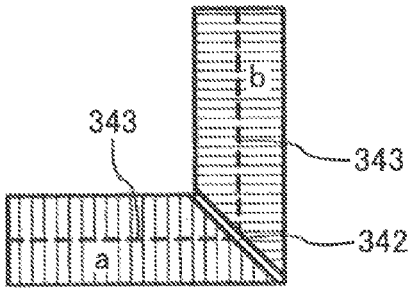
FIG. 25B is a side view of a part of the box-like member of the buffer.

Arrows shown on respective surfaces of the box-like member 310 shown in FIG. 25A indicate the direction of grain of the plastic cardboard material, and in the arrangement shown in FIGS. 21, 22A, and 22B, the direction of grain of the plastic cardboard material is vertical. Furthermore, as shown in FIG. 25B, after the assembly of the box-like member 310, there is a gap 342 between two plates constituting the corner of the L shape. Since there is a fold 343 on surfaces a and b of the box-like member 310, when it is pressed hard, the surfaces a and b bend as shown in FIG. 25. According to such a configuration, cushioning performance can be increased, while maintaining the strength of the buffer.

Figure 26:
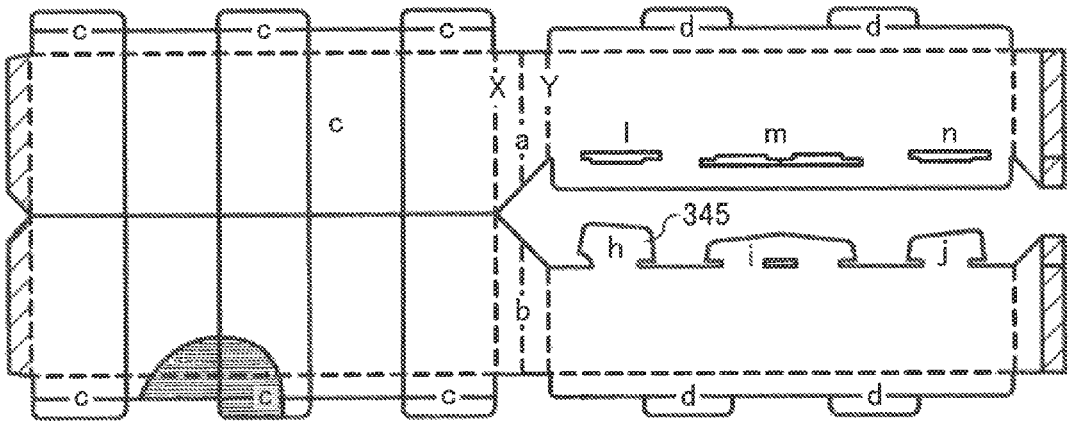
FIG. 26 is a development view of the box-like member.

The box-like member 310 is made of plastic cardboard material. The box-like member 310 is formed by bending one plate material cut as shown in FIG. 26 according to a procedures (A) to (D):

(A) Bend the plate material, designating XY as an axis from the right toward the left in FIG. 26.

(B) Bond margins (shaded portions) on both sides together.

(C) Insert d between c and c at the top and the bottom in FIG. 26 so that these engage with each other.

(D) Insert the protrusion h on the b side into the slit l on the a side, insert the protrusion i on the b side into the slit m on the a side, and insert the protrusion j on the b side into the slit n on the a side.

The buffer 300 substantially in an L shape is completed in this manner.

Figure 25C:
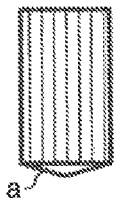
FIG. 25C is a side view of a part of the box-like member of the buffer.

The buffer 300 is then arranged in the packaging device 100 (200) so that the surfaces $\alpha$ and $\beta$ abut on the corner of the product 10, with the surfaces a and b in FIG. 25A upward. At this time, as shown in FIGS. 25B and 25C, since the surfaces a and b can be bent, when the corner of the product 10 presses the surfaces $\alpha$ and $\beta$ of the box-like member 310 due to vibration in the horizontal direction at the time of transport, the surfaces a and b of the buffer 300 bend, and the PET bottles 330 arranged in the buffer 300 reliably absorb the vibration of the product 10.

According to the sixth embodiment, to facilitate the replacement of the PET bottles 330, the protrusions h, I, and j are simply inserted into the slits l, m, and n and not bonded together. Therefore, when the corner of the product 10 presses the surfaces $\alpha$ and $\beta$ of the buffer, a force of the protrusions h, I, and j slipping out from the slits l, m, and n is applied. Particularly, when the box-like member 310 is arranged longitudinally, the protrusion h located at the top can slip out. In the sixth embodiment, to prevent this, the buffer is formed in the following manner, from (E) to (H):

(E) The protrusion h has a longer length toward the slit insertion direction, as compared to the length of other protrusions I and j.

(F) An engagement portion 345 of the protrusion h, which is hooked by the internal circumference of the slit l, is formed in a curved shape, and the left end of the protrusion h is located on the left side of the left guide hole of the slit l.

(G) The height of the slit l is made higher than that of the slit m.

(H) Right guide holes of the slits l, m, and n are extended toward the right further than the right end of the protrusions h, i, and j.

In FIG. 26, the protrusions h, i, and j are inserted into the slits l, m, and n, while shifting the protrusions h, i, and j toward the right. When the hand is released, the protrusions tend to return to the left side in FIG. 26. The engagement portion 345 at the left end of the protrusion h enters into the inside of the slit l from the left end guide, and engages with and overlaps on the slit in the left and right direction in FIG. 26. As a result, even if the buffer 300 is arranged with the protrusion h being upward, since the engagement portion 345 engages with the slit l, slipping out of the protrusion from the slit can be prevented.

According to the sixth embodiment, the PET bottles 330 are arranged in the same direction longitudinally as shown in FIG. 22B, or alternately in the opposite direction as shown in FIG. 23 so that the bottle portions 330*a* and the caps 330*b* of the PET bottles, respectively, come in contact with each other as shown in FIG. 23. The PET bottles can be arranged laterally, instead of longitudinally as in this example. At this time, by making the longitudinal direction of the PET bottles 330 and the grain of the plastic cardboard material parallel to each other, the product 10 is buffered both by the hollow portion constituting the grain and the hollow portion of the PET bottles. Accordingly, the impact of the product 10 can be buffered.

To use the buffer 300 according to the sixth embodiment, as shown in FIG. 21, the buffer 300 is put between the corner of the product 10 and the corner of the packaging device 100 (200), and the product 10 is pressed by a packaging belt.

While the buffer 300 is substantially in the L shape in the sixth embodiment, as shown in FIGS. 24A and 24B, a buffer 400, in which PET bottles 430 are arranged in a thin rectangular box-like member 410, can be arranged between the product and one surface of the packaging device 100 (200). Also in this case, the arrangement pattern of the PET bottles 430 can be variously changed.

A seventh embodiment of the present invention is explained next.

Figure 27:
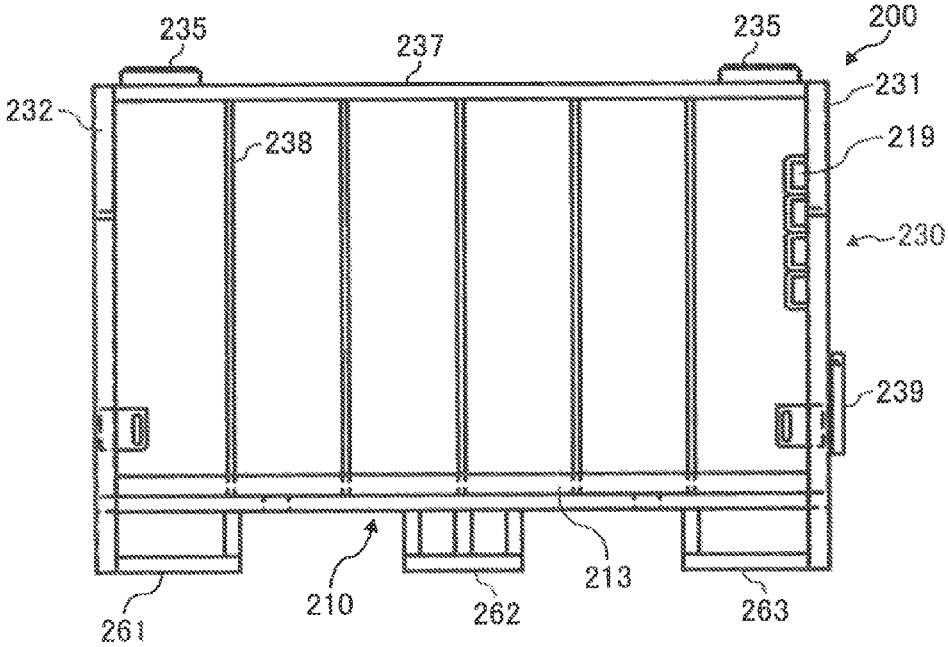
FIG. 27 is a side view of a bottom base of a packaging device according to a seventh embodiment of the present invention.

FIG. 27 is a side view of a bottom base 210 of a packaging device 600 according to the seventh embodiment.

Figure 28A:
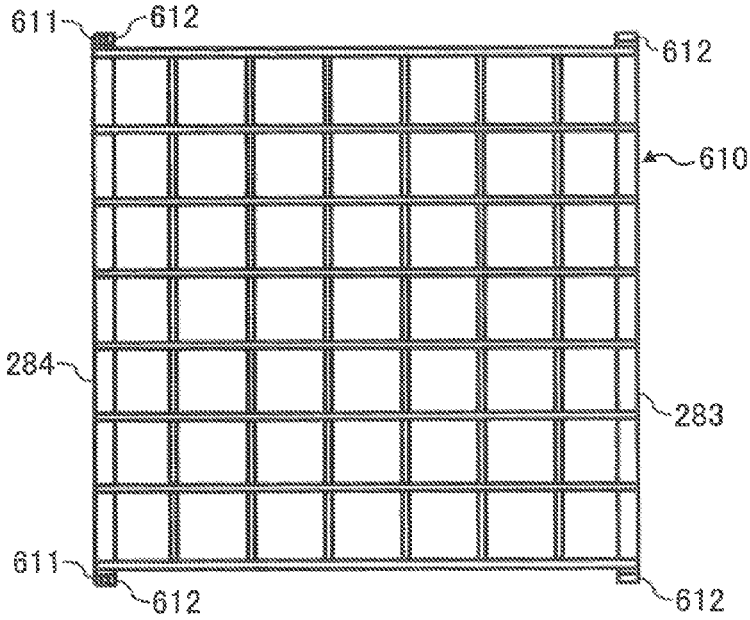
FIG. 28A is a plan view of a top panel member of the packaging device according to the seventh embodiment.
Figure 28B:
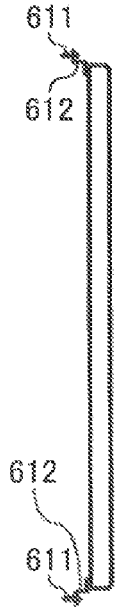
FIG. 28B is a side view of the top panel member of the packaging device according to the seventh embodiment.
Figure 28C:
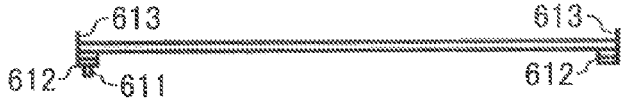
FIG. 28C is a side view of the top panel member of the packaging device according to the seventh embodiment.

FIG. 28A is a plan view of a top panel member 610 of the packaging device 600 according to the seventh embodiment. FIGS. 28B and 28C are side views of the top panel member 610 of the packaging device 600 according to the seventh embodiment.

Figure 29A:
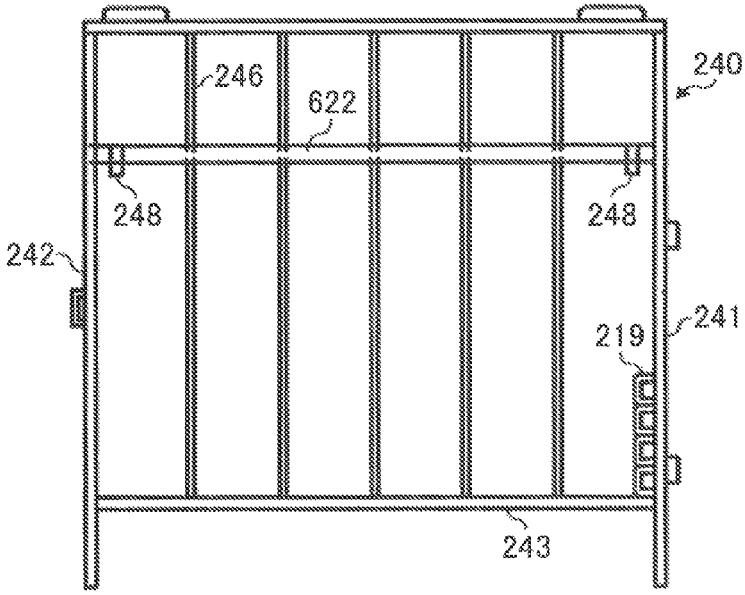
FIG. 29A is a front view of an upper transverse member of the packaging device according to the seventh embodiment.
Figure 29B:
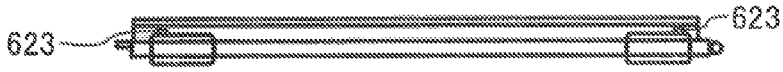
FIG. 29B is a plan view of the upper transverse member of the packaging device according to the seventh embodiment.
Figure 29C:
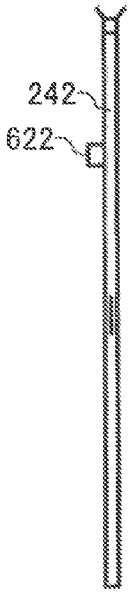
FIG. 29C is a side view of the upper transverse member of the packaging device according to the seventh embodiment.

FIGS. 29A, 29B, and 29C are, respectively, a front view, a plan view, and a side view of the upper transverse member 240 of the packaging device 600 according to the seventh embodiment.

Figure 30:
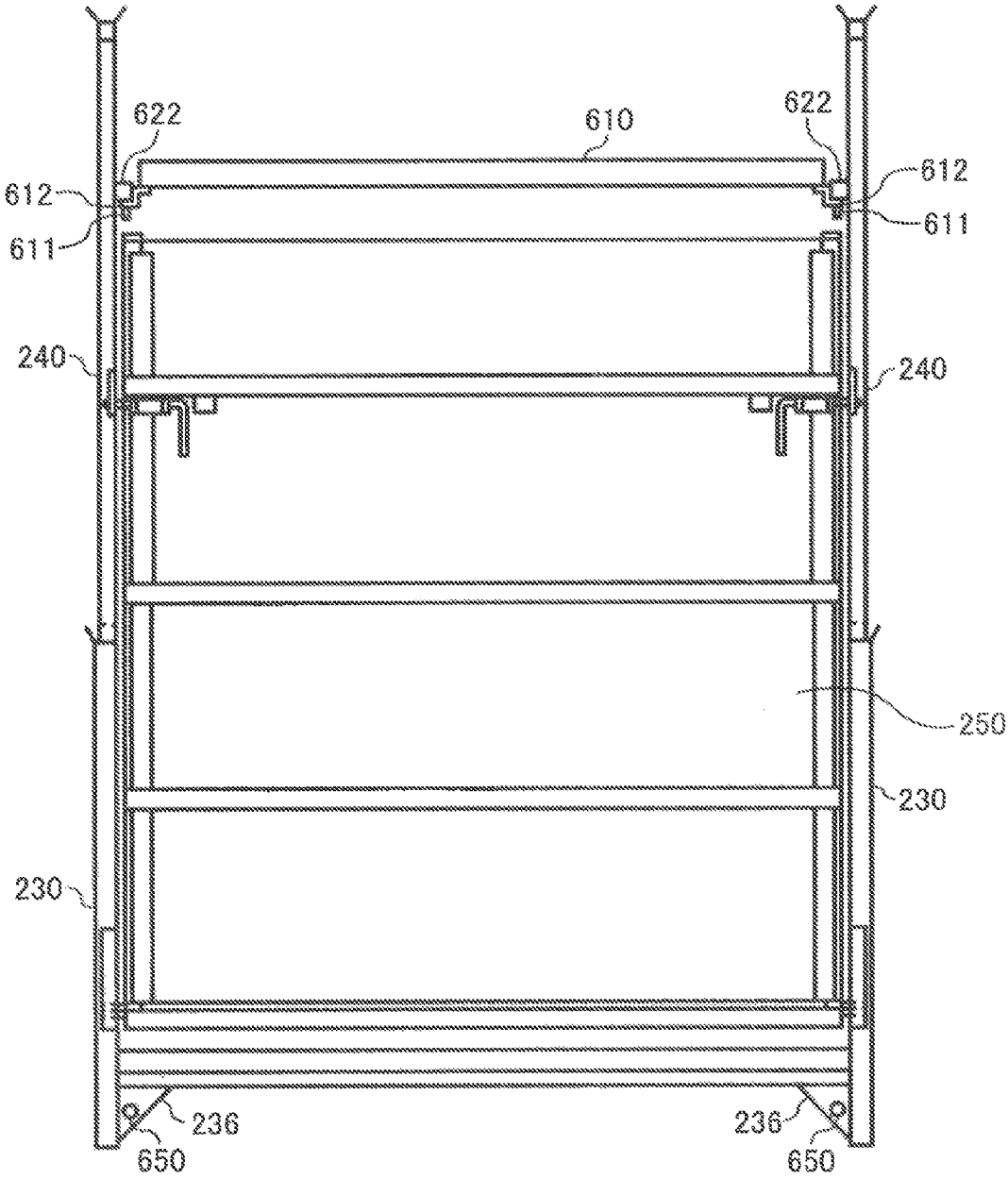
FIG. 30 is a front view when the top panel member in the packaging device according to the seventh embodiment is
Figure 31:
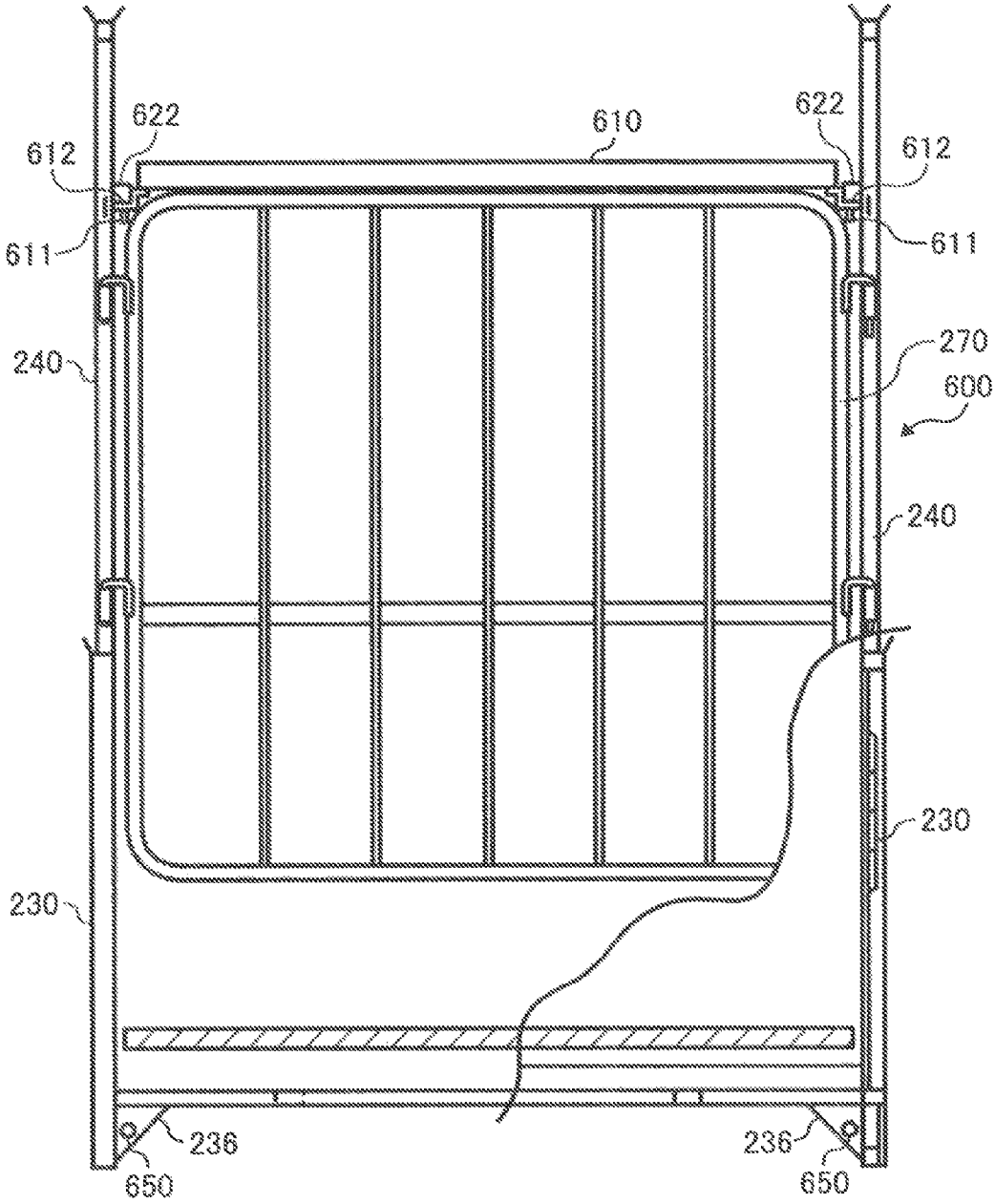
FIG. 31 is a back view when the top panel member in the packaging device according to the seventh embodiment is mounted.
Figure 32:
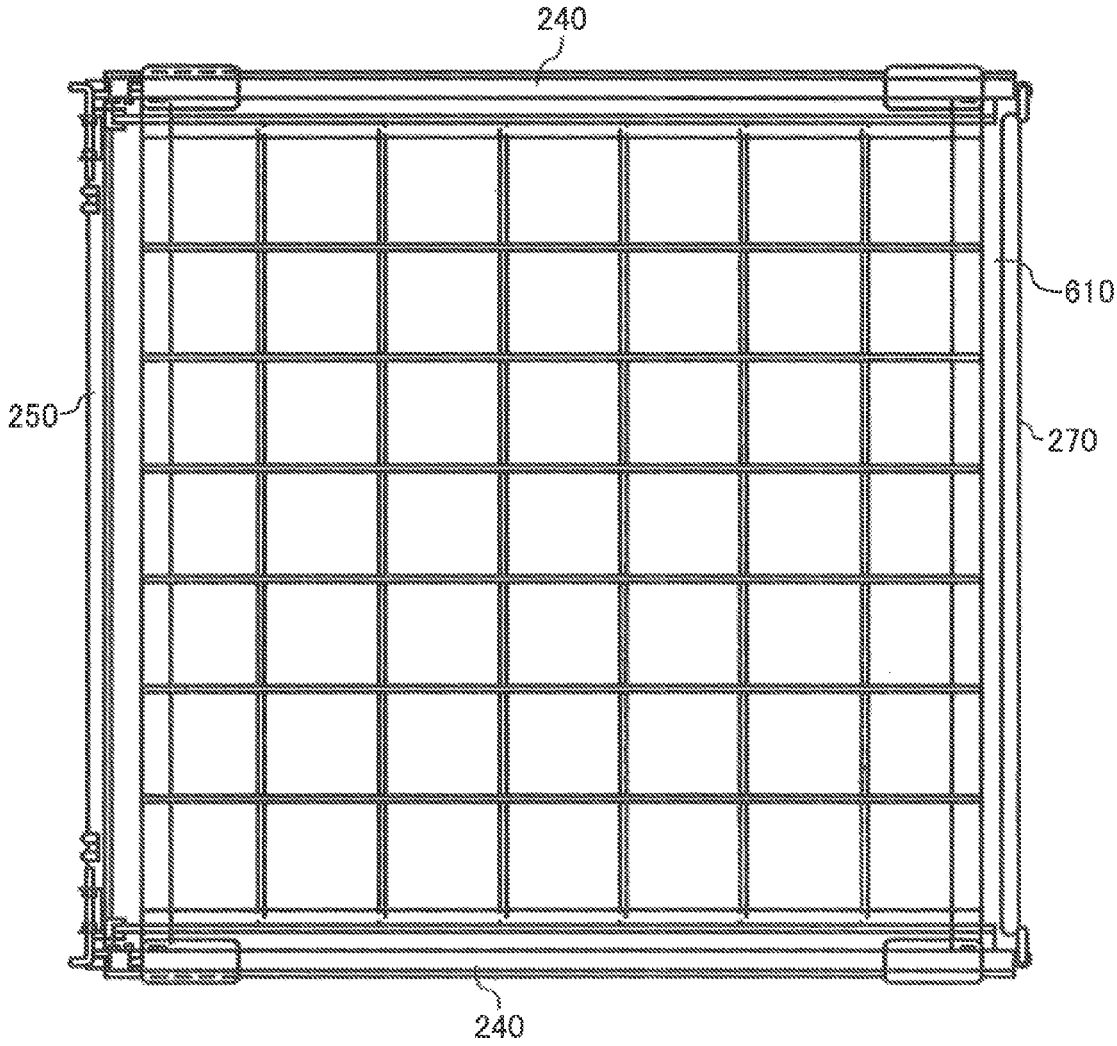
FIG. 32 is a plan view when the top panel member in the packaging device according to the seventh embodiment is mounted.

FIGS. 30, 31, and 32 are, respectively, a front view, a back view, and a plan view when the top panel member 610 in the packaging device according to the seventh embodiment is mounted.

The schematic configuration of the packaging device 600 according to the seventh embodiment is the same as that of the packaging device 200 according to the fifth embodiment, except that the top panel member 610 can be slid and detached. Therefore, like parts are denoted by like reference numerals, and the explanation thereof is omitted.

In the top panel member 610 of the packaging device 600 according to the seventh embodiment, the frame 284 includes the engagement member 287, as in the top panel member 280 shown in FIGS. 20A and 20B, and is engaged with the fitting guide 248 of the upper transverse member 240 by placing the top panel member 610 from above, with the position thereof adjusted with respect to the fitting guide 248. In this case, since the top panel member 610 is made of steel, it is not easy for one worker to lift the heavy top panel member 610 upward horizontally and position the engagement member 287 to the fitting guide 248. However, according to the seventh embodiment, even one worker can position the top panel member 610 with respect to the body of the packaging device 600.

In the top panel member 610 according to the seventh embodiment, as shown in FIGS. 28A, 28B, and 28C, a guide 612 is provided on the frame body 283, which slides on a sliding guide 622 (see FIGS. 29A and 29C) provided on the upper pillar member 241 of the upper transverse member 240. According to the seventh embodiment, a locking protrusion 611 that engages with a hole 623 provided at a predetermined position of the sliding guide 622 is provided at the opposite ends of the frame 284. Furthermore, as shown in FIG. 29B, the hole 623 is provided at the opposite ends of the sliding guide 622, so that the frame 284 of the top panel member 610 can be slid from the left to the right in FIG. 29A, and fitted to the hole 623 in the sliding guide 622, both on the front side and the other side of the packaging device 600.

According to this configuration, the worker places one side of the guide 612 or the locking protrusion 611 on the guide face of the sliding guide 622 on the front side of the packaging device 600, slides the top panel member 610 toward the other side of the packaging device 600 along the sliding guide 622, to guide the top panel member 610 to the position engaging with the hole 623 in the sliding guide 622, and thereafter, engages the locking protrusion 611 with the hole 623 to fix the top panel member 610.

The position in the height direction of the sliding guide 622 is set such that it is higher than the upper face of the front member 250 on the front side of the packaging device 600 as shown in FIG. 30, and on the rear side of the device 600, as shown in FIG. 31, the upper face of the rear member 270 and the lower face of the top panel are at the same position. According to the seventh embodiment, as shown in FIGS. 30 and 31, a belt engaging hole 650 is opened, respectively, in the corner plate 236 for reinforcement.

A protrusion 613 is provided, as shown in FIG. 28C, above of the frames 284 and 283, so that it is prevented that an article placed on the top panel (for example, a box or the like that packs attachments of the product to be mounted on the mounting base 180) falls from the packaging device 600, for example as shown in FIG. 32, in the state that the top panel member 610 is fitted.

Furthermore, as shown in FIG. 27, the belt fixing unit 219 that fixes a belt 640 used for preventing misregistration of the product 10 mounted on the mounting base 180 is provided on the lower transverse member 230 and the upper transverse member 240 at the rear side of the packaging device 600.

Figure 33A:
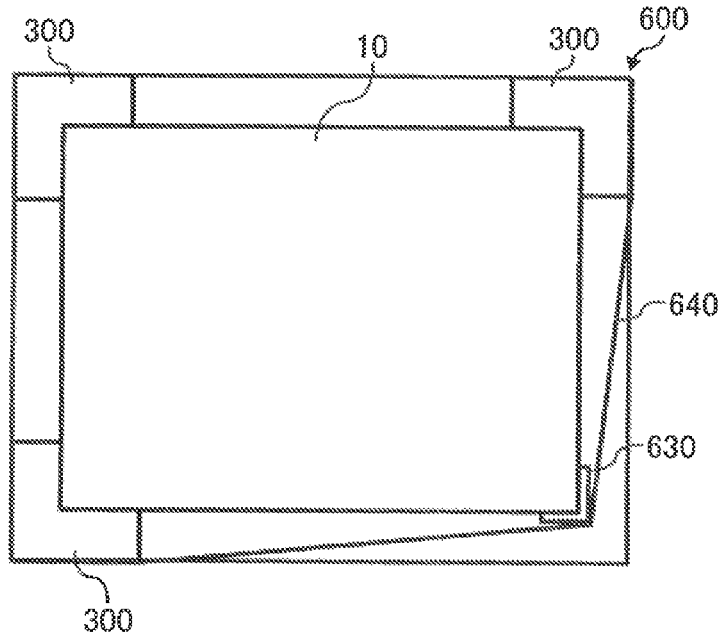
FIG. 33A is a plan view of a fixed state of a product in the packaging device according to the seventh embodiment.
Figure 33B:
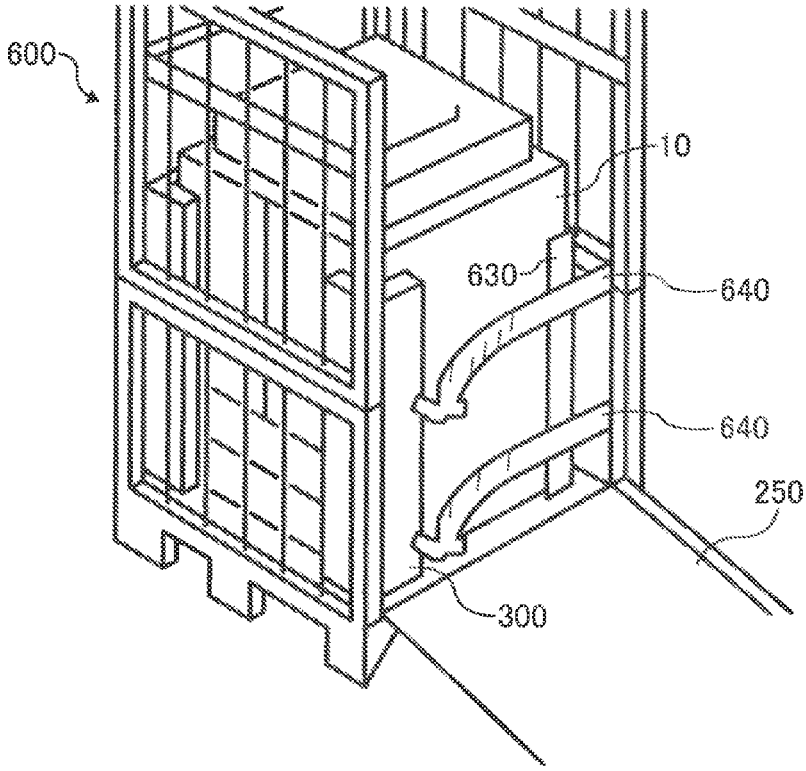
FIG. 33B is a perspective view of the fixed state of the product in the packaging device according to the seventh embodiment.

When the product 10 is packed using the packaging device 600 according to the seventh embodiment, the product 10 wrapped in a bag (of a reusable or recyclable material) is mounted on the mounting base 180, and as shown in FIG. 33A, the buffer 300 explained in the sixth embodiment is arranged respectively at the left and right corners on the other side, and the left corner on the front side. At the other corners, the second plate-like buffer 630 made of polypropylene or the like is arranged, and fixed by two belts 640 as shown in FIG. 33B. The one end of the belt 640 is hooked to the belt fixing unit 219, and the other end is hooked to the frame on the front side, as shown in FIG. 33B. The reason why the second buffer 630 is provided in this manner is that the force of the belt 640 is directly applied to this corner, and the box-like member 310 can be greatly damaged.

Thus, the product 10 is mounted on the mounting base 180, positioned by two sides, of the four sides, pressed against the two sides, and fixed by the belt 640.

Figure 34A:
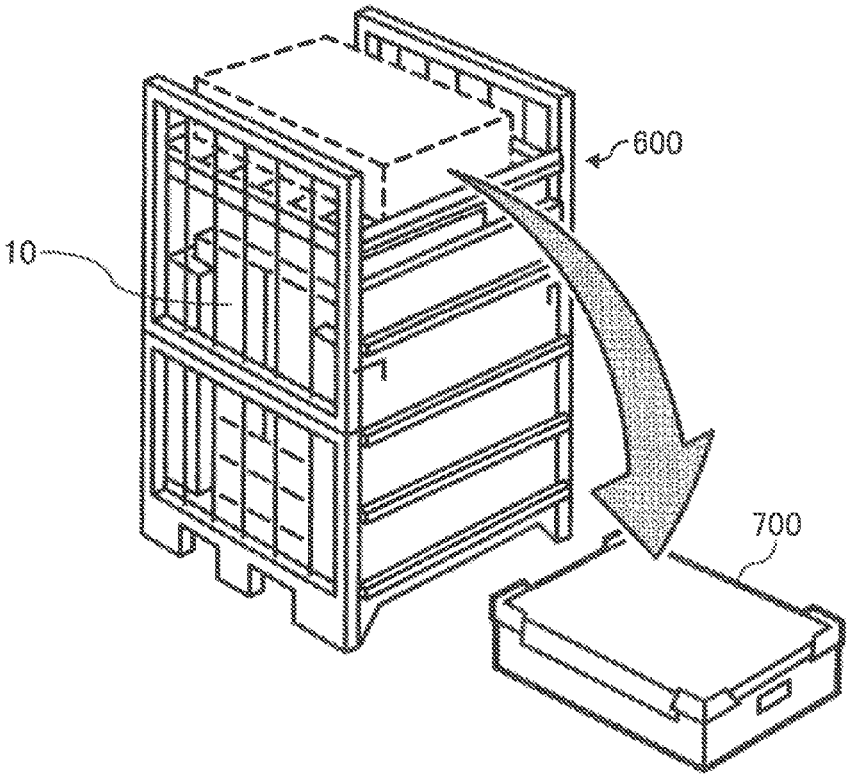
FIGS. 34A to 34F depict an unpacked state of the packaging device according to the seventh embodiment, and are perspective views of unpacking procedures.
Figure 34B:
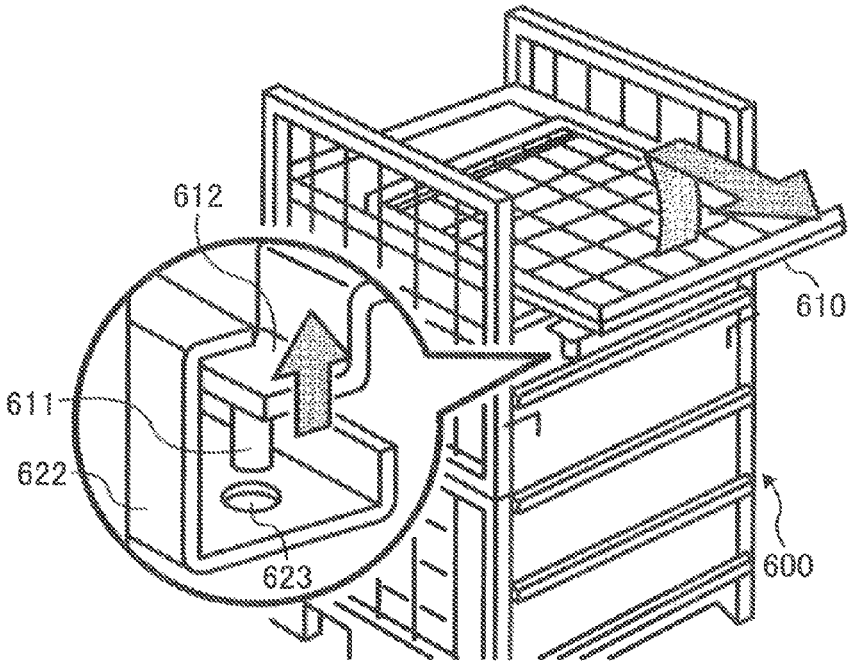
Figure 34C:
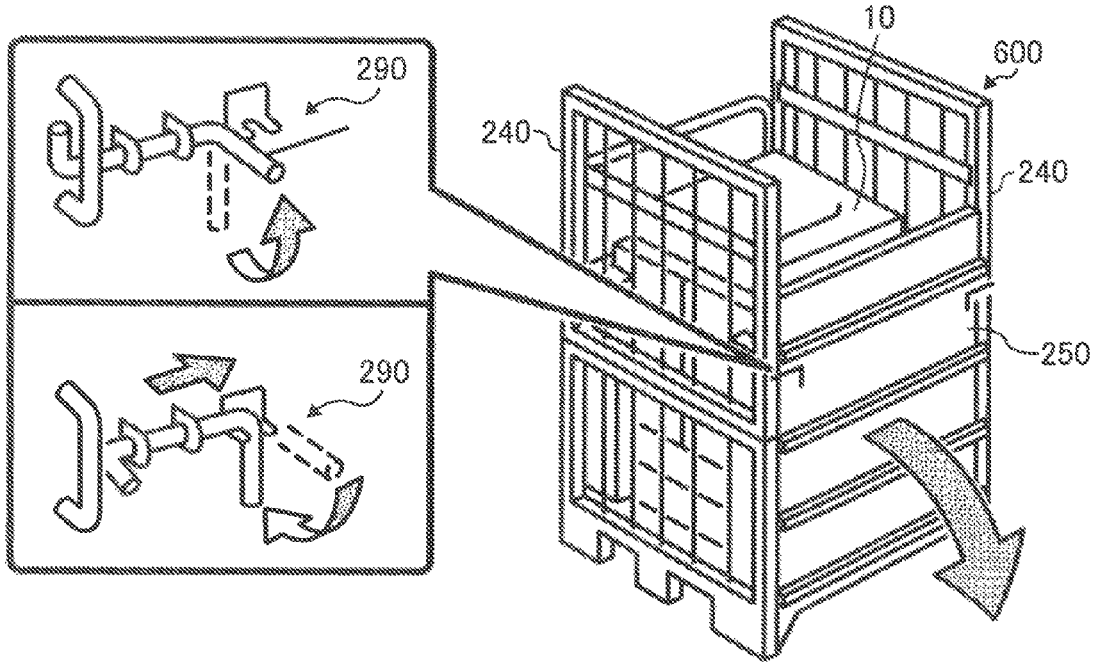
Figure 34D:
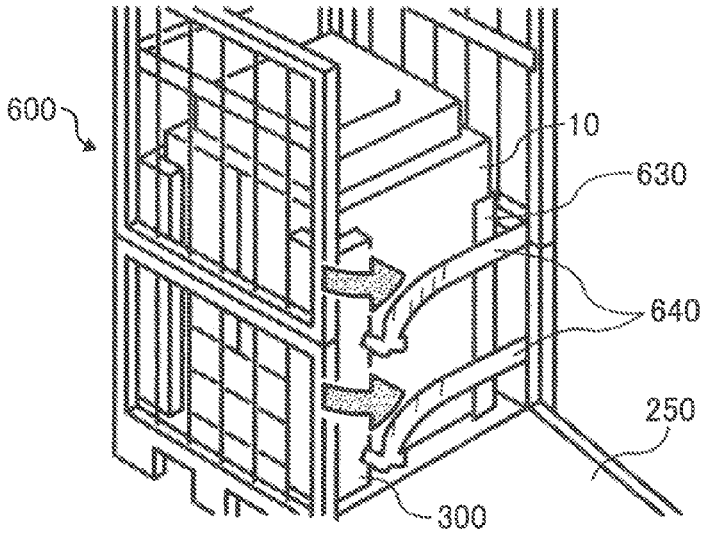
Figure 34E:
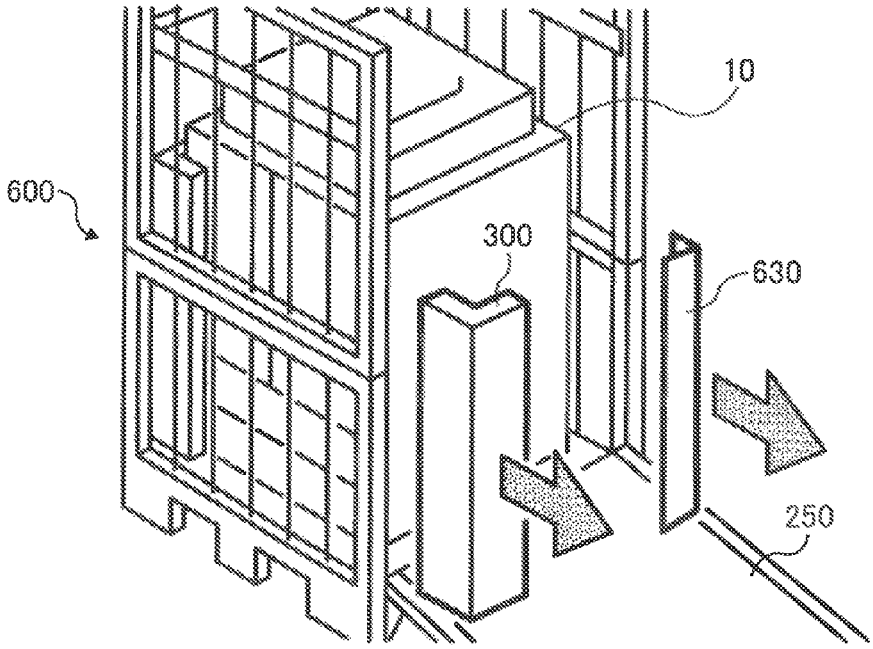
Figure 34F:
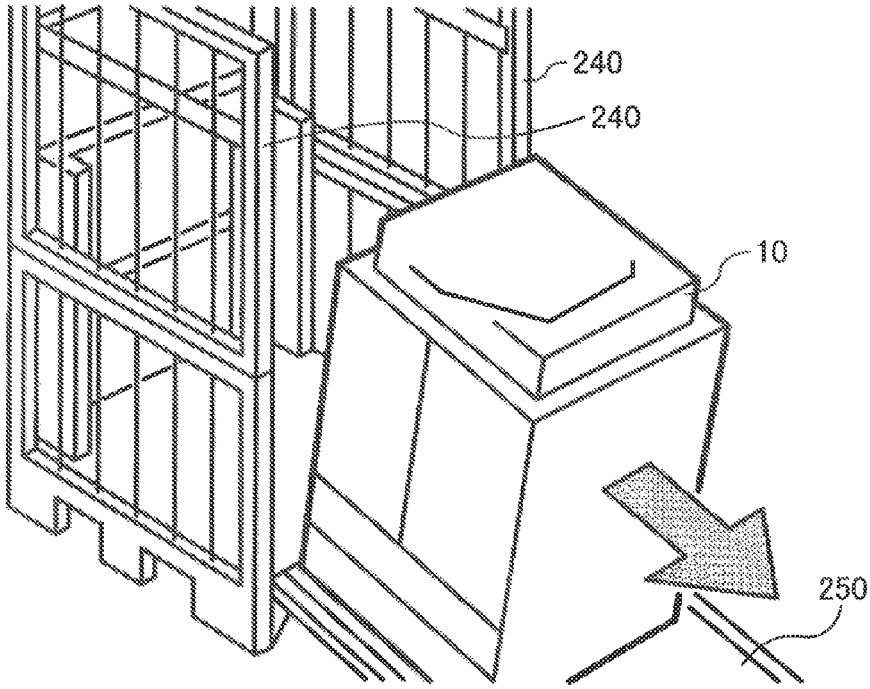

The opening procedure is explained below based on FIGS. 34A to 34F. At first, a box 700 mounted on the top panel member 610 is brought down (FIG. 34A). The locking protrusion 611 of the top panel member 610 is removed from the hole 623 in the sliding guide 622, and the top panel member 610 is pulled out toward the front side of the packaging device 600, and detached (FIG. 34B). The lock of the locking device 290 on the front member 250 is released, and the front member 250 is inclined toward the front side (FIG. 34C). The belt 640, the buffer 300 on the front side of the packaging device 600 and the second buffer 630 are detached (FIGS. 34D and 34E), and the product 10 is unloaded using the slope made by the front member 250, thereby finishing unpacking (FIG. 34F).

Figure 35A:
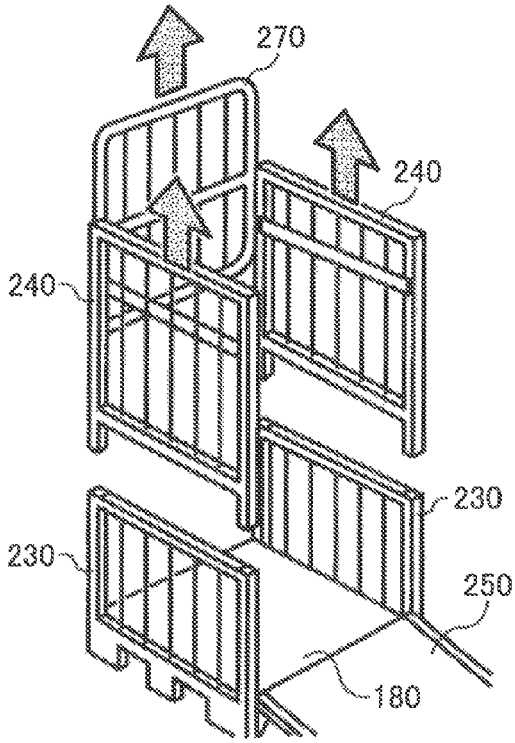
FIGS. 35A to 35D depict a collecting state of the packaging device according to the seventh embodiment, and are perspective views of collection procedures.
Figure 35B:
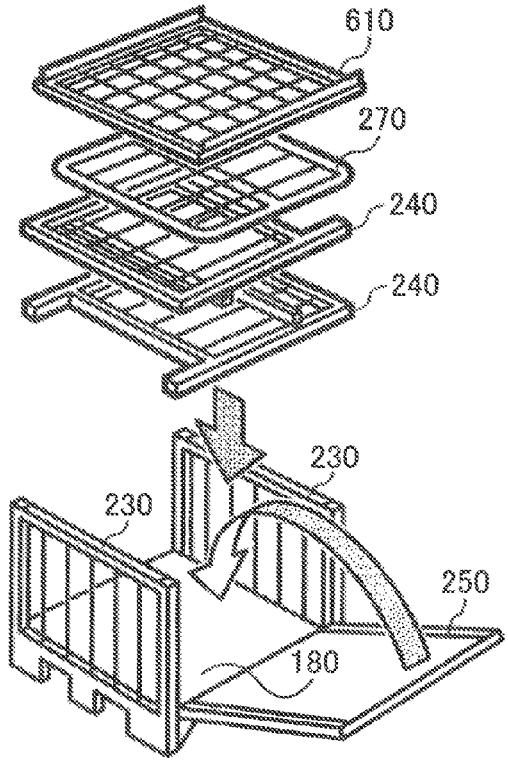
Figure 35C:
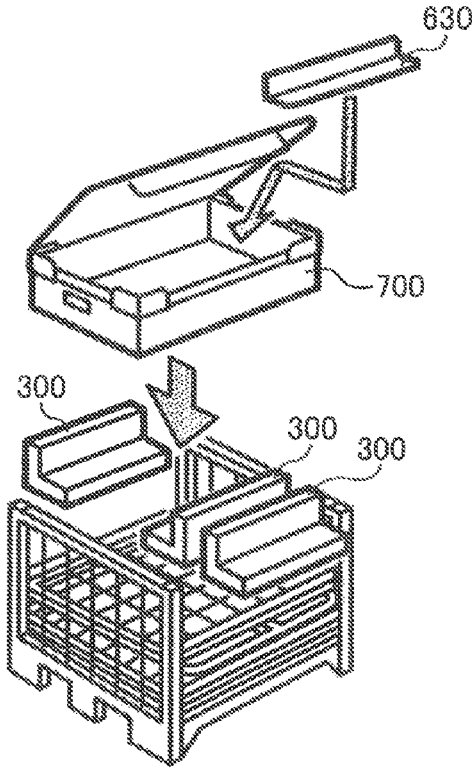
Figure 35D:
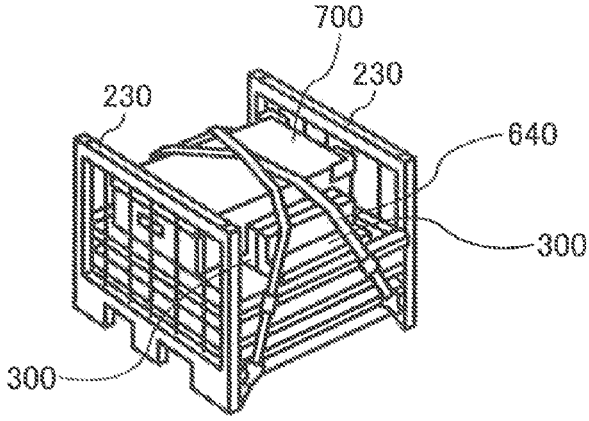

After the unpacking is finished, in a case that an old copying machine is collected from the delivery destination, the old machine can be packed and collected by tracing back the above procedure. As an example, it is assumed that there is no product to be collected at the delivery destination, and only the packaging device 600 is collected. As shown in FIGS. 35A to 35D, the rear member 270 and the upper transverse member 240 are pulled upward (FIG. 35A). The front member 250 is then folded onto the mounting base 180, and the rear member 270, the upper transverse member 240, and the top panel member 610 are overlapped thereon (FIG. 35B). The two buffers 300 are arranged back to back and one buffer 300 is further arranged with a space therebetween on the overlapped members, and the box 700, which has been mounted on the top panel, is arranged between the buffers. In this box, the second buffer 630 can be housed, and the bag, which has wrapped the product 10, can be folded and housed as well (FIG. 35C). Lastly, the belt 640, which has positioned the product 10 is locked and fixed to the belt engagement hole 650 (FIG. 35D). Thus, a plurality of members constituting the packaging device 600 can be reliably collected in a compact manner, without causing a drop.

According to the seventh embodiment, the front member 250, the upper transverse member 240, the top panel member 610, and the rear member 270 are formed in a size housed within the surface of the mounting base 180. These members are overlapped on each other, and the uppermost position when the buffer 300 and the box 700 are further overlapped thereon is equal to or lower than the position of the beam 237. When the two buffers 300 back to back and the other one buffer 300 are arranged with a space therebetween, and the box 700, which has been mounted on the top panel member 610, is arranged in the space, the length between the ends of the buffers 300 is smaller than the width of the mounting base 180, or smaller than the width of the front member 250, the upper transverse member 240, the top panel member 610, and the rear member 270. Accordingly, these members can be locked by the belt 640 and reliably collected without falling down from the packaging device 600.

According to this configuration, an excess space is not created, and even the box 700 for carrying the attachments to be mounted on the top panel member 610 can be placed within the packaging device 600. As a result, the collection efficiency can be improved. At the time of collection, the legs 261 and 263 are mounted on the guide plate 235 of the beam 237 of the folded packaging device 600, overlapped and collected, thereby realizing space saving of the packaging device 600. The assembled packaging device 600 can be piled up.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A packaging device for a generally rectangular article, comprising:

a bottom plate supporting the article;

a plurality of support members arranged on the bottom plate orthogonal to the bottom plate and enclosing the article;

a cushioning unit arranged on the bottom plate in a space enclosed by the support members and at at least two diagonal corners of the article supported on the bottom plate, the cushioning unit including a plurality of airtight containers filled with gas, wherein the cushioning unit has a bifacial outside corner contact portion, and a bifacial inside corner contact portion which can come in contact with a respective corner of the article supported on the bottom plate, and is formed substantially in a shape of a letter L;

a mounting plate arranged above the cushioning unit in the space enclosed by the support members for mounting an article; and a belt mounted to the bottom plate or support members so as to press a cushioning unit at one of the corners of the article supported on the bottom plate toward the cushioning unit at the diagonally opposite corner of the article supported on the bottom plate.

2. The packaging device according to claim 1, wherein the plurality of support members include a first member detachably attached to the bottom plate orthogonal to the bottom plate between two adjoining first support members, a second member firmly attached to the bottom plate orthogonal to the bottom plate between two adjoining second support members that are different from the first support members, a plurality of transverse members attached between a support member of the first support member and adjoining support member of the second support member, and a third member latched to an upper part of at least two of the first member, the second member, and the transverse members.

3. The packaging device according to claim 2, further comprising a sliding unit that slides the third member and fits it to the upper part of at least two of the first member, the second member, and the transverse members.

4. The packaging device according to claim 1, wherein the airtight containers include bottle-shaped containers having a hollow part and a bottom, and each airtight container has a body having at least one opening, and a closing body detachable from the opening of the body, which closes the opening.

5. The packaging device according to claim 1, wherein the airtight containers are arranged with predetermined regularity.

6. The packaging device according to claim 1, further comprising four plate members arranged orthogonal to the bottom plate in a manner to enclose the cushioning unit.

7. The packaging device according to claim 2, wherein the transverse members include a first transverse member detachably attached to upper part of the support members, and a second transverse member attached to lower part of the support members, the second transverse member having a connecting member.

8. The packaging device according to claim 2, wherein the first member, the second member, the transverse members, and the third member are detachable from the bottom plate.

9. The packaging device according to claim 8, wherein the mounting plate includes an arrangement for mounting the first member, the second member, the transverse members, and the third member that are detached from the bottom plate.

10. The buffer according to claim 1, wherein each of the airtight containers is a bottle having a wall part, a bottom part, and a top part all enclosing an hollow space;

an opening in the top part; and a closing body detachably attached to the top part in the opening for closing the bottle.

11. The packaging device according to claim 1, wherein the belt presses on a bifacial outside corner of the cushioning unit at the one of the corners of the article supported on the bottom plate.

12. The packaging device according to claim 1, wherein the cushioning unit at one of the corners of the article supported on the bottom plate is made of polypropylene.

* * * * *